US012460910B1

(12) United States Patent
Routhier et al.

(10) Patent No.: US 12,460,910 B1
(45) Date of Patent: Nov. 4, 2025

(54) REDUCED ENERGY MARKING CARTRIDGES PROVIDING A MULTI-PHASE FIRING CYCLE

(71) Applicant: General Dynamics Ordnance and Tactical Systems—Canada, Inc., Repentigny (CA)

(72) Inventors: Yann Routhier, Terrebonne (CA); Alison Daigle, Charlemagne (CA); Nicholas Blanchard, Saint-Paul (CA); Sylvain Berthiaume, Repentigny (CA)

(73) Assignee: GENERAL DYNAMICS ORDNANCE AND TACTICAL SYSTEMS—CANADA, INC., Repentigny (CA)

( * ) Notice: Subject to any disclaimer, the term of this patent is extended or adjusted under 35 U.S.C. 154(b) by 0 days.

(21) Appl. No.: 18/769,536

(22) Filed: Jul. 11, 2024

(51) Int. Cl.
*F42B 5/045* (2006.01)
*F42B 14/06* (2006.01)

(52) U.S. Cl.
CPC ..... *F42B 14/067* (2013.01)

(58) Field of Classification Search
CPC ..... F42B 8/10; F42B 5/045; F42B 5/145
See application file for complete search history.

(56) References Cited

U.S. PATENT DOCUMENTS 5,042,388 A * 8/1991 Warren ..... F42B 5/045 102/434
6,422,149 B1 7/2002 Saxby
7,207,276 B1 * 4/2007 Dindl ..... F42B 5/02 102/443
7,225,741 B2 6/2007 Huffman
7,278,358 B2 10/2007 Huffman
8,327,767 B2 * 12/2012 Lafortune ..... F42B 8/02 102/446
8,485,102 B2 7/2013 Carlson et al.
9,470,492 B2 10/2016 Carlson et al.
9,494,397 B2 11/2016 Carlson et al.
9,534,877 B2 * 1/2017 Huffman ..... F42B 8/02
11,280,598 B2 3/2022 Kralj
11,287,235 B2 3/2022 Lafortune
11,656,063 B2 * 5/2023 Doiron ..... F41A 21/24 102/430
2014/0130695 A1 * 5/2014 Chong ..... F41B 11/80 102/334

(Continued)

FOREIGN PATENT DOCUMENTS

CA 2621708 C 4/2013
WO 2015/034442 A1 3/2015
WO 2015/256643 A1 12/2020

*Primary Examiner* — Derrick R Morgan
(74) *Attorney, Agent, or Firm* — Ingrassia Fisher & Lorenz, LLP

(57) ABSTRACT

A reduced energy marking cartridge includes a casing supporting a sabot for relative sliding movement and defining a combustion chamber at the breech end of the cartridge and a vent chamber at the muzzle end of the cartridge. An assembly of seals and radial venting passages in the sabot, which may be in the form of notches, slots or holes, cooperate during the relative movement of the casing and sabot to provide a valving mechanism for controlling the flow of combustion gas from the combustion chamber through the venting chamber and into the acceleration chamber for propelling a projectile from the cartridge.

20 Claims, 13 Drawing Sheets

(56) References Cited

U.S. PATENT DOCUMENTS

| | | | | |
|---|---|---|---|---|
| 2014/0216292 | A1* | 8/2014 | Theodore, Jr. | F42B 8/10<br>102/447 |
| 2014/0311332 | A1* | 10/2014 | Carlson | F41A 5/18<br>89/191.01 |
| 2020/0348114 | A1* | 11/2020 | Feese | F42B 14/06 |
| 2022/0146238 | A1* | 5/2022 | Doiron | F42B 5/045 |

* cited by examiner

REDUCED ENERGY MARKING CARTRIDGES PROVIDING A MULTI-PHASE FIRING CYCLE

TECHNICAL FIELD

The technical field relates generally to cartridges for firearms, and more particularly, relates to reduced energy marking cartridges configured to precisely control the phases in a firing cycle.

BACKGROUND

This section provides background information related to the present disclosure which is not necessarily prior art.

Significant resources are spent annually to train military forces and police departments in the use of their service weapons. One type of training employs reduced-energy cartridges designed to simulate service rounds for non-lethal training.

An advantage of the reduced-energy training ammunition is that it has a shorter range and lower penetration capacity than standard ammunition. A weapon firing reduced-energy marking rounds makes an effective close-range, force-on-force training system. This system enhances the realism and training value of interactive scenario tactical training because it allows trainees to use their service weapons in a representative manner for simulated exercises, e.g., counter-terrorism, close quarters combat, urban fighting, protection of dignitaries, trench clearing, and fighting in wooded areas.

Early developments of this technology was disclosed in U.S. Pat. No. 5,035,183, entitled "The Frangible Nonlethal Marking Projectile Design" issued to Luxton and U.S. Pat. No. 5,359,937 entitled "The Reduced Energy Cartridge" issued to Dittrich, which, introduced the world to Simunition FX® marking cartridges. Subsequent development has focused on improvements in the ballistics and marking performance of the projectile, for example as disclosed in U.S. Pat. No. 11,287,235 entitled "Enhanced Polymer Marking Projectile For Nonlethal Cartridge" to Lafortune.

Further improvements are needed to enhance the manufacturing, operation and performance of this technology. Accordingly, it is desirable to provide more precise control over the firing of a reduced energy marking cartridge, while maintaining sufficient energy to ensure complete and repeatable case ejection at the end of the firing cycle. Other desirable features and characteristics of the present invention will become apparent from the subsequent detailed description of the invention and the appended claims, taken in conjunction with the accompanying drawings and this background of the invention.

SUMMARY

The reduced energy marking cartridge described herein includes a casing supporting a sabot for relative sliding movement and defining a combustion chamber at the breech end of the cartridge and a venting chamber at the muzzle end of the cartridge and an acceleration chamber in the sabot. An assembly of seals and venting passages, which may be in the form of notches, slots or holes, cooperate during the relative movement of the casing and sabot to provide valving for controlling the flow of combustion gas from the combustion chamber through the venting chamber and into the acceleration chamber. The configuration of these seals and venting passages and the relative volume provided in the combustion chamber, venting chamber and acceleration chamber can be precisely tuned to accumulate sufficient combustion gas at suitable pressure for propelling the projectile during the firing phase, and cycling the weapon to eject the cartridge during the venting phase. A reduced energy marking cartridge in accordance with the present disclosure provides a sabot having radially venting configurations that are initially sealed during an expanding phase of the firing cycle. Sliding movement of the sabot relative to the casing unseals the radial vent hole(s) and directs combustion gas into the acceleration chamber for propelling the projectile from the cartridge. A reduced energy marking cartridge in accordance with the present disclosure is more simple and less expensive to manufacture and has more consistent performance characteristic including improved cartridge ejection and lower standard deviation for bullet velocity.

In one aspect, a reduced-energy cartridge is provided that includes a casing having an axial bore with an aft portion extending from a base at a breech end of the cartridge and a fore portion terminating at a muzzle end of the cartridge. A sabot is telescopically received in the axial bore and coupled to the casing for relative movement from a retracted position to an extended position. The sabot includes a sabot body, a sabot mouth formed at the muzzle end, a blind bore extending axially from the sabot mouth into the sabot body to form an acceleration chamber, and a vent hole extending radially through the sabot body into the acceleration chamber. A first seal is disposed on the sabot body and engages the aft portion of the casing to form a combustion chamber between the base and the sabot body. A second seal is disposed on the sabot body between the first seal and the sabot mouth and engages the fore portion of the casing to form a venting chamber around the sabot body. A propellant is disposed in the aft portion of the casing and ignitable to produce a combustion gas. A projectile is releasably disposed in the sabot mouth and configured to be propelled from the sabot.

The multi-phase firing cycle includes: a combustion phase, wherein the first seal engages the aft portion to seal the vent hole from the combustion chamber such that combustion gas pressurizes the combustion chamber for sliding the casing relative to the sabot; a firing phase, wherein the first seal disengages the aft portion and fluid communication is established from the combustion chamber through the vent hole for pressurizing the acceleration chamber to propel the projectile from the sabot mouth; and a venting phase, wherein the vent hole is in fluid communication with the venting chamber for expelling combustion gas from the casing through the sabot mouth.

In another aspect, a reduced-energy cartridge is provided that includes a casing having an axial bore including an aft portion extending from a base at a breech end of the cartridge and a fore portion terminating at a muzzle end of the cartridge. A sabot telescopically received in the axial bore and coupled to the casing for relative movement from a retracted position to an extended position. The sabot includes a sabot body, a sabot mouth formed at the muzzle end, a blind bore extending axially from the sabot mouth into the sabot body to form an acceleration chamber, and a vent hole extending radially through the sabot body into the acceleration chamber. A first sealing means is configured for forming a combustion chamber at the breech end between the casing and the sabot body. A second sealing means is configured for forming a venting chamber at the muzzle end between the casing and the sabot body. A propellant is disposed in the aft portion of the casing and ignitable to produce a combustion gas. A projectile releasably disposed in the sabot mouth and configured to be propelled from the sabot.

The multi-phase firing cycle includes: a combustion phase, wherein the sabot is positioned in the casing such that the first sealing means is operable for sealing the vent hole from the combustion chamber for pressurizing the combustion chamber with combustion gas for pushing the sabot forward relative to the casing; a firing phase, wherein the sabot is position in the casing such that the first sealing means and second sealing means are operable for establishing fluid communication from the combustion chamber into the venting chamber through the vent hole and into the acceleration chamber to propel the projectile from the sabot mouth; and a venting phase, wherein the sabot is position in the casing such that the first sealing means and second sealing means are operable for establishing fluid communication from the combustion chamber into the venting chamber through the vent hole and the acceleration chamber and out the sabot mouth for expelling combustion gas from the casing through the sabot mouth.

In yet another aspect, a multi-phase firing cycle is provided for firing a reduced-energy cartridge having a casing, a sabot telescopically received and supported in an axial bore of a casing and for relative axial movement from a retracted position to an extended position, and a projectile releasably disposed in a mouth at a muzzle end of the sabot. The multi-phase firing cycle includes: igniting a propellant in a combustion chamber formed in the casing behind the sabot to generate combustion gas during an ignition phase; pressurizing the combustion chamber with combustion gas for sliding the casing relative to the sabot during a combustion phase; positioning the sabot in the casing to direct combustion gas from the combustion chamber through a radial hole formed in the sabot and into an acceleration chamber formed in the sabot for propelling the projectile from the mouth of the sabot during a firing phase; and positioning the sabot in the casing to direct combustion gas from the combustion chamber into a venting chamber through the radial hole and into the acceleration chamber for expelling the combustion gas from the casing.

The multi-phase firing cycle may further include at least one of the following sequences: (i) positioning the sabot in the casing to direct combustion gas from the combustion chamber into the venting chamber and through the radial hole for pressurizing the acceleration chamber during the firing phase; (ii) positioning the sabot in the casing to establish fluid communication from the combustion chamber into the venting chamber during the firing phase; and positioning the sabot in the casing to seal the venting chamber before, during and/or after an expansion phase after the firing phase.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations and are not intended to limit the scope of the present disclosure.

Corresponding reference numerals set forth in the drawings indicate corresponding parts throughout the several views of the drawings.

DETAILED DESCRIPTION

A detailed description of example embodiments is hereinafter provided with reference to the accompanying drawings. This detailed description is intended to be considered in light of the other portions of the specification, claims and drawings. There is no intention to be limited by any principle presented herein. Various embodiments contemplated herein relate to reduced energy marking cartridges providing a multi-stage firing cycle for non-lethal training as summarized above.

In principle, the reduced energy marking cartridge includes a casing and a sabot telescopically received and supported within the casing for relative axial movement from a retracted position to an extended position. A projectile is releasably disposed in the sabot and in fluid communication with an acceleration chamber formed in the body of the sabot. The casing and the sabot cooperate to define a combustion chamber at the breech end of the cartridge and a vent chamber at the muzzle end of the cartridge. An assembly of seals and venting passages cooperate during the relative movement of the casing and sabot to provide a valving mechanism for controlling the flow of combustion gas from the combustion chamber through the venting chamber and into the acceleration chamber.

Figure 1:
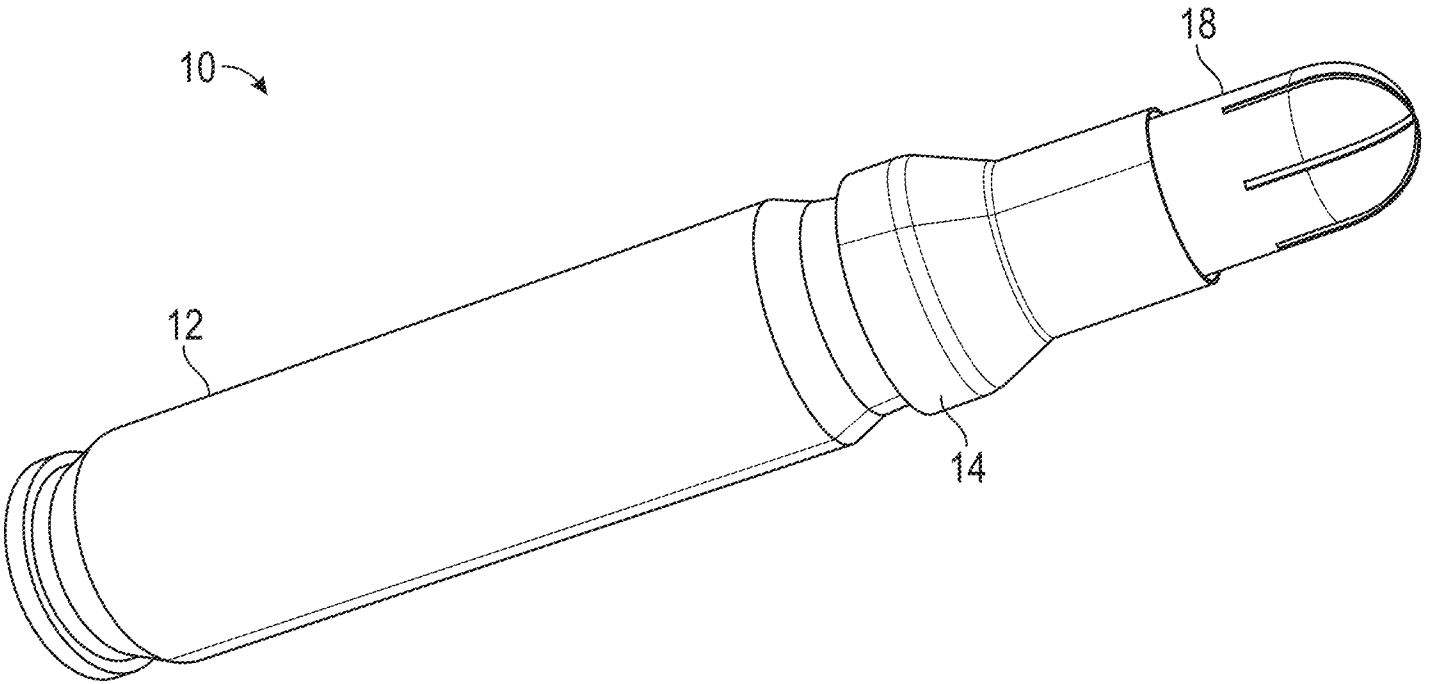
FIG. 1 shows a perspective view of an embodiment of the marking cartridge described below.
Figure 2:
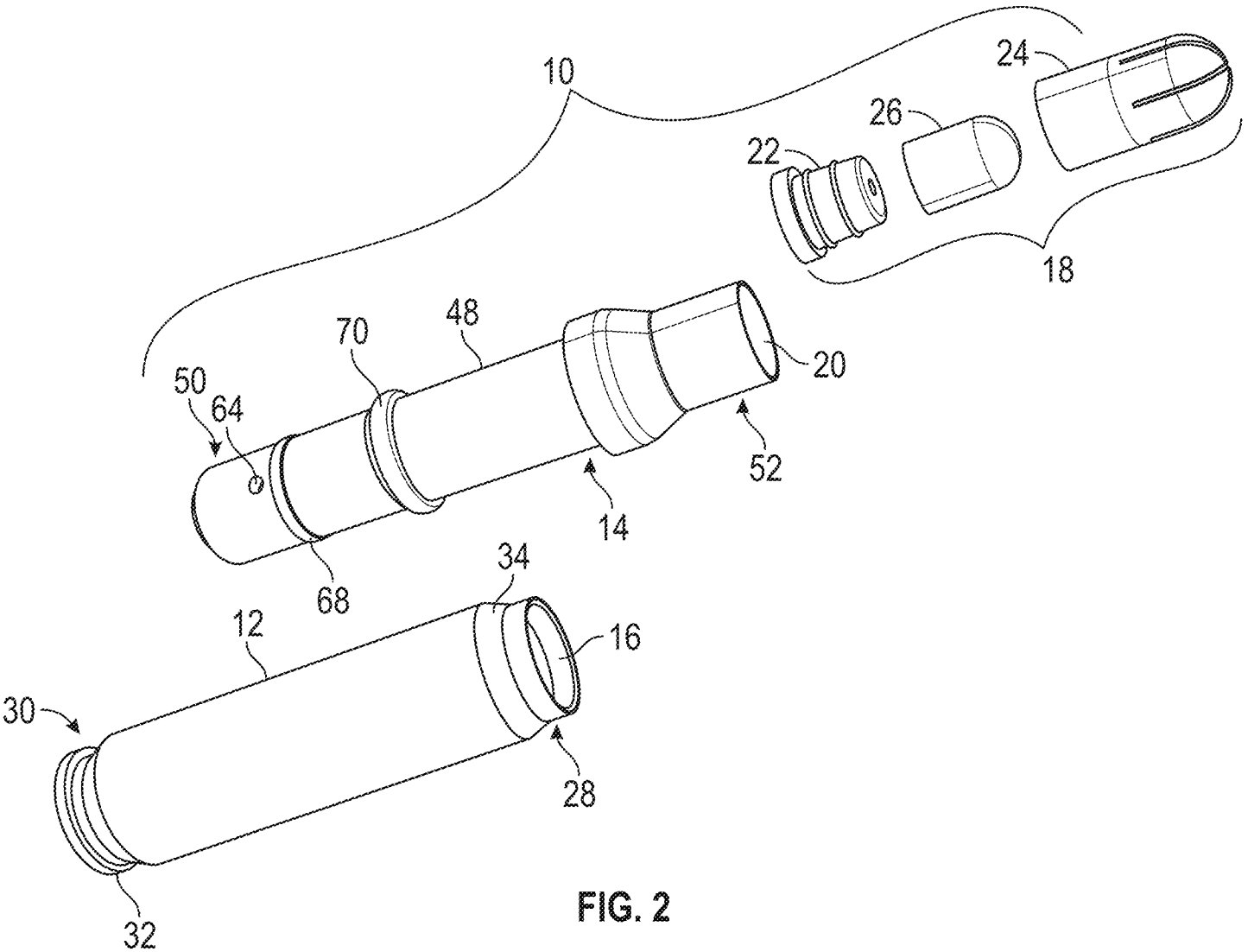
FIG. 2 shows an expanded view of the marking cartridge shown in FIG. 1.
Figure 7:
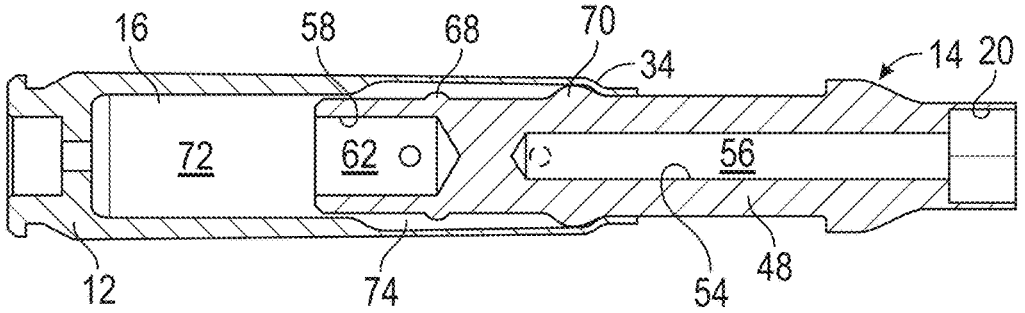
FIG. 7 shows a cross-section similar to FIG. 3 in the venting phase of the firing cycle.

With reference to FIGS. 1-2, an exemplary embodiment provides a cartridge 10 having a shell case or casing 12 and a sabot 14 telescopically received and supported in an axial bore 16 of the casing 12 for relative axial movement from a retracted position (FIG. 4) to an extended position (FIG. 7). The cartridge 10 also includes a projectile 18 releasably disposed in a mouth 20 of the sabot 14. The casing 12 and the sabot 14 may be formed of any suitably rigid material for withstanding the temperatures and pressure generated during the firing cycle. Brass or aluminum alloys are preferred materials for the casing 12. A polymeric material such as a homopolymer acetal (e.g., DuPont Delrin®) is a preferred material for the sabot 14.

The projectile 18 may be a nonlethal, marking projectile, which includes a base 22, a frangible shell 24 coupled to the base 22 and a marking compound 26 enclosed in the shell 24 by the base 22. The frangible shell 24 is configured to "mushroom" upon impact with a target then break apart on the target for consistently releasing the marking compound 26. Suitable projectiles are described in the following U.S. Patents: U.S. Pat. Nos. 8,485,102, 8,539,885, U.S. Ser. No. 10/088,287, U.S. Ser. No. 11/287,235 and U.S. Ser. No. 11/402,187, the disclosures of which are expressly incorporated by reference herein.

With reference now to FIGS. 1-7, the structures of the marking cartridge 10 and their spatial relationship for achieving a multi-phase firing cycle are further described. The casing 12 is a thin walled cylindrical component having an axial bore 16 extending from a muzzle end 28 toward a breech end 30 and terminating at a base 32. The muzzle end 28 of the casing 12 includes a tapered portion 34 extending from the fore portion 38 to the muzzle end 28 of the casing 12, which functions as a stop for limiting the travel of the sabot 14 relative to the casing 12 during the firing cycle. The tapered portion 34 also serves to provide a seal to the sabot 14 at the muzzle end 28 of the casing 12. The tapered portion 34 also serves to provide a seal between the sabot 14 and the casing 12.

Figure 3:
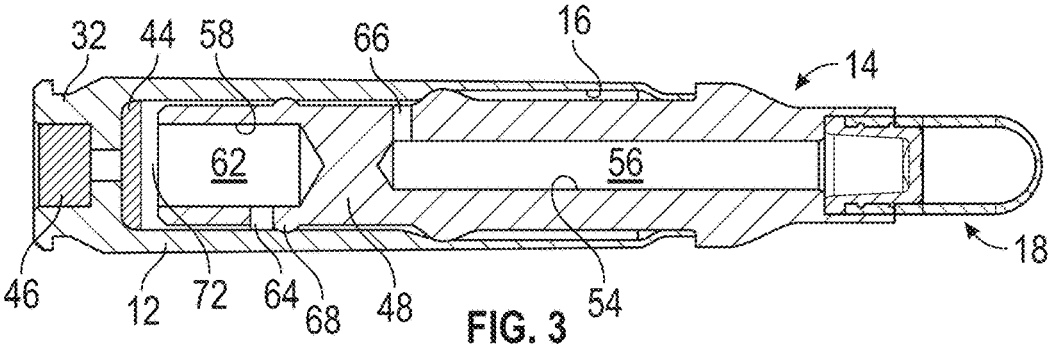
FIG. 3 is a cross-section of the marking cartridge taken along III-III in FIG. 1.
Figure 4:
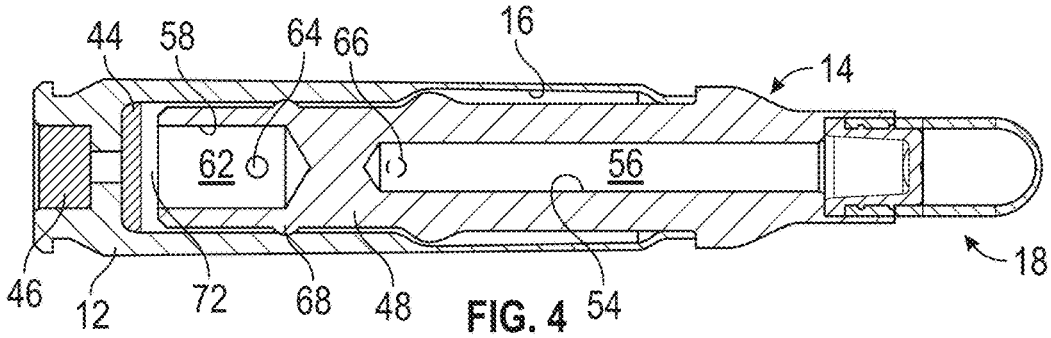
FIG. 4 is a cross-section of the marking cartridge taken along IV-IV in FIG. 1.
Figure 5:
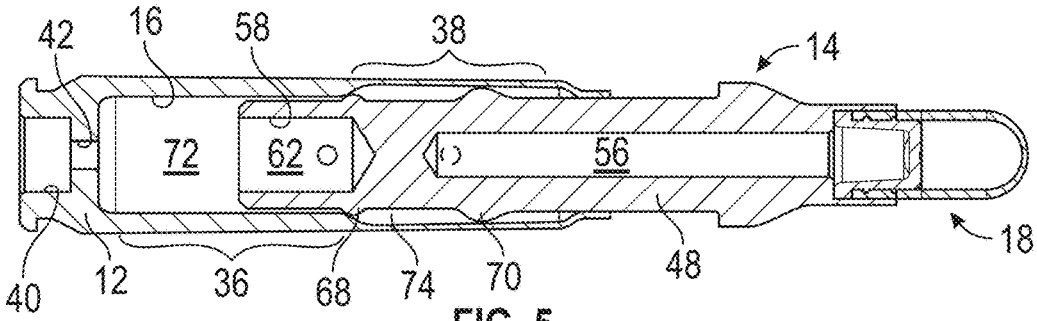
FIG. 5 shows a cross-section similar to FIG. 3 in the expansion phase of the firing cycle.

The axial bore 16 is divided into an aft portion 36, and a fore portion 38 between the aft portion 36 and the muzzle end 28. As best seen in FIGS. 3-7, the inner diameter of the aft portion 36 is smaller than the inner diameter of the fore portion 38. As seen in FIG. 5, primer pocket 40 is formed in the base 32 and has a flash port 42 extending from the primer pocket 40 to the axial bore 16. As seen in FIGS. 3 and 4, a propellant 44 is disposed in the aft portion 36 of the axial bore 16 adjacent the base 22 and a primer 46 is disposed in the primer pocket 40 for igniting the propellant 44 through the flash port 42.

The sabot 14 includes a sabot body 48 having a breech end 50 and a muzzle end 52 forming the sabot mouth 20. A blind bore 54 extends axially from the sabot mouth 20 into the sabot body 48 to form an acceleration chamber 56. A blind bore 58 extends from the breech end 50 of the sabot body 48 to form a sabot chamber 62. A bleed port or first vent hole 64 extends radially through the sabot body 48 into the sabot chamber 62. A second vent hole 66 extends radially through the sabot body 48 into the acceleration chamber 56. The second vent hole 66 as best seen in FIG. 3 is represented as a dashed circle in FIGS. 4-7. While the first and second vent holes 64, 66 are illustrated as cylindrical through bores, the present disclosure contemplates that the number, shape and size of the through bores may be varied to achieve the desired fluid communication of combustion gas (e.g., pressure, flow rate and velocity) therethrough. A first seal 68 is formed on the sabot body 48 between the first vent hole 64 and the second vent hole 66. A second seal 70 is formed on the sabot body 48 forward (in the direction of the muzzle end 52) of the second vent hole 66. In this embodiment, the second seal 70 functions as a catch for engaging an interface between the fore portion 38 and the tapered portion 34 of the casing 12 to limit the travel of the sabot 14 at the extended position relative to the casing 12. The axial bore 16 including the inner surfaces of the aft and fore portions 36, 38 cooperate with the sabot body 48 including the seals 68, 70 to support the sabot 14 for sliding movement relative to the casing 12 and resist relative rotational movement, namely pitch and yaw of the sabot 14 relative to the casing 12.

The first seal 68 is sized and configured to provide sealing engagement with the aft portion 36 of the axial bore 16. The axial location of the first seal 68 relative to the sabot body 48 may be adjusted to achieve the desired stroke length and firing timing. The second seal 70 is sized and configured to provide sealing engagement with the fore portion 38 of the axial bore 16. Furthermore, the second seal 70, in combination with the size and configuration of the tapered portion 34 of the casing 12 may be sized and configured to minimize the radial stress imparted on the casing 12 by the sabot 14 sliding into the fully extending position for ensuring that the sabot 14 is retained the casing 12 and for allowing proper cycling of the cartridge 10.

The above-described features of the casing 12 and the sabot 14 cooperate to provide a valving mechanism employing sealing means for effecting the multi-phase firing cycle. As shown in FIGS. 3 and 4, the first seal 68 of the sabot 14 engages the aft portion 36 (FIGS. 5 and 6) of the casing 12 to define a sealed combustion chamber 72 (including the sabot chamber 62) of the casing 12 between the base 32 and the breech end 50 of the sabot body 48 which includes the sabot chamber 62. In this configuration, the aft portion 36 and the first seal 68 provide a first sealing means between the base 32 of the casing 12 and the sabot body 48.

As shown in FIG. 5, the sabot 14 has moved forward (to the right) relative to the casing 12 such that the first seal 68 disengages from the aft portion 36 of the axial bore 16 and is positioned in the fore portion 38. The second seal 70 engages the walls of the fore portion 38 to form a venting chamber 74 behind (to the left) of the second seal 70. The first vent hole 64 remains loosely sealed in the aft portion 36 of the axial bore 16. In this configuration, the aft portion 36, the fore portion 38 and the second seal 70 provide a second sealing means. Combustion gas continues to pressurize the combustion chamber 72, although some combustion gas may leak into the venting chamber 74.

The choke characteristics of the valving mechanism may be effective controlled, in the first instance, by adjusting the gap defined between the inner diameter of fore portion 38 and the outer diameter of the first seal 68 as well as the configuration of the second vent hole 66. In particular, the gap defines an inlet area to the venting chamber 74 and the second vent hole defines an outlet area from the venting chamber 74. The ratio of the inlet area to the outlet area can be tuned to provide suitable choke characteristics for achieving the desired cycling time and projectile velocity of the marking cartridge 10. For example, a ratio of at least 2:1 has been found to be suitable in some applications. Different ratios may be more suitable in other applications based on the characteristics of a particular marking cartridge and/or weapon system. The choke characteristics of the valving mechanism may be effectively controlled, in the second instance, by adjusting size and location of the first vent hole 64. While the embodiment shown in FIGS. 1-8 includes a sabot chamber 62 with a first vent hole 64, one skilled in the art should appreciate that on or both of these features in the sabot body 48 may be omitted as illustrated in the embodiments shown in FIGS. 13-15 and 19-27.

Figure 6:
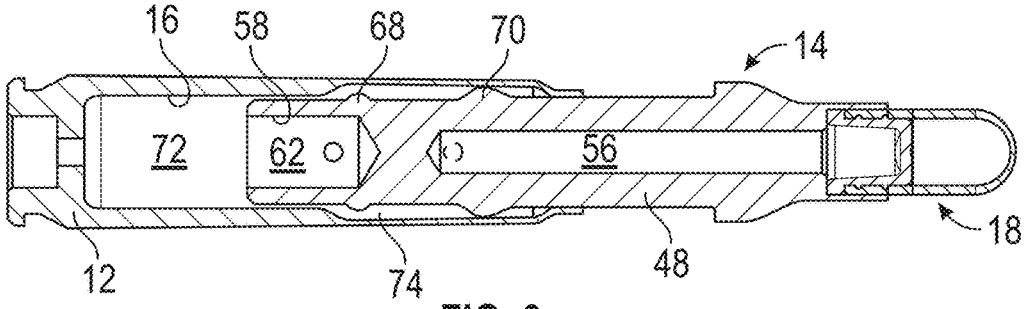
FIG. 6 shows a cross-section similar to FIG. 3 in the firing phase of the firing cycle.

As shown in FIG. 6, the sabot 14 has to move further forward relative to the casing 12 such that the first vent hole 64 is positioned in the venting chamber 74. Fluid communication of propellent gas is established from the combustion chamber 72 via the first vent hole 64 through the venting chamber 74 and into the acceleration chamber 56 via the second vent hole 66. Pressure in the acceleration chamber 56 increases to a level for dislodging the projectile 18 from the sabot mouth 20 and propelling it into a barrel bore (not shown).

As shown in FIG. 7, the sabot 14 has moved further forward and the second seal 70 of the sabot body 48 engages the tapered portion 34 formed on the casing 12. With the projectile (not shown) discharged from the cartridge 10, the vent holes 64, 66 provide fluid communication from the combustion chamber 72 and the venting chamber 74 through the acceleration chamber 56 and the sabot mouth 20 to depressurize the cartridge 10.

Figure 8:
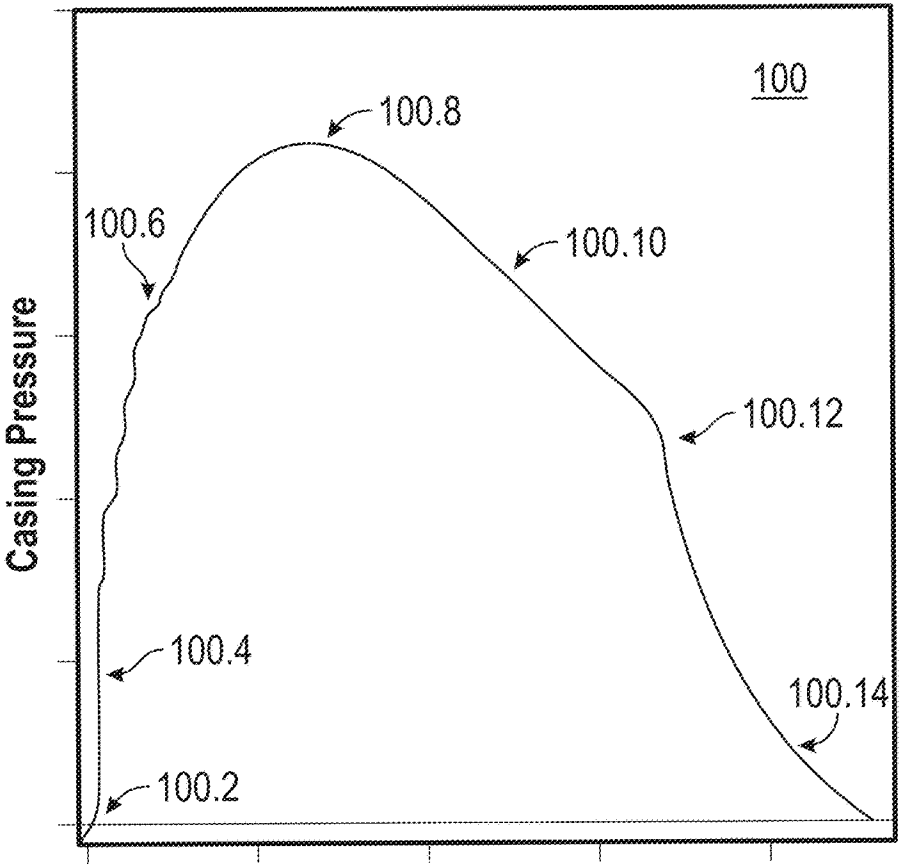
FIG. 8 is a plot of time vs. casing pressure graphically illustrating the schema of the multi-phase firing cycle of the marking cartridge shown in FIG. 3-7.

During a firing cycle of the cartridge 10, the above-described features cooperate to provide a multi-phase firing cycle 100 as schematically represented in FIG. 8. The multi-phase firing cycle 100 includes an ignition phase 100.2 during which the primer 46 is struck by a firing pin (not shown) and ignites the propellant 44 in the combustion chamber 72. At 100.4 in the firing cycle 100, an expansion phase is initiated and the sabot 14 begins to slide relative to the casing 12. The burning propellant generates combustion gas which pressurizes the combustion chamber 72 during a combustion phase 100.4 (FIG. 3-4). The pressurized combustion gas continues to force the casing 12 and sabot 14 in opposite directions (FIG. 5) causing the sabot 14 to slide relative to the casing 12 during the combustion phase 100.6, which ends at 100.8. The expansion phase continues post-combustion at 100.10 until relative movement of the casing 12 and the sabot 14 moves the first seal 68 into the fore portion 38 of the axial bore 16. Continued relative movement of the casing 12 and the sabot 14 positions the first vent hole 64 in the venting chamber 74 (FIG. 6) to initiate a firing phase 100.12, which enables combustion gas to pressurize the acceleration chamber 56 from the combustion chamber 72 via the first and second vent holes 64, 66. At the end of the firing phase, sufficient pressure has accumulated in the acceleration chamber 56 to dislodge the projectile 18 from the sabot mouth 20 and fire the projectile 18 from the cartridge 10. Thereafter, a venting phase 100.14 (FIG. 7) is initiated once the projectile 18 has been fired. The first vent hole 64 establishes fluid communication with the venting chamber 74 for venting combustion gas from the combustion chamber 72, through the vent hole 66 and into the acceleration chamber 56 for expelling combustion gas from the casing 12. At the end of the venting phase 100.14, the sabot 14 has reached the extended position relative to the casing 12 when the second seal 70 on the sabot body 48 engages the tapered portion 34 formed in the casing 12.

Turning now to FIGS. 9-24 and 29-32, alternate embodiments of a reduced energy marking cartridge are illustrated. One skilled in the art should appreciate that the modification described and illustrated in these alternate embodiments may substitute, augment or otherwise revise the features, components and operation of the marking cartridge 10 heretofore described.

Figure 9:
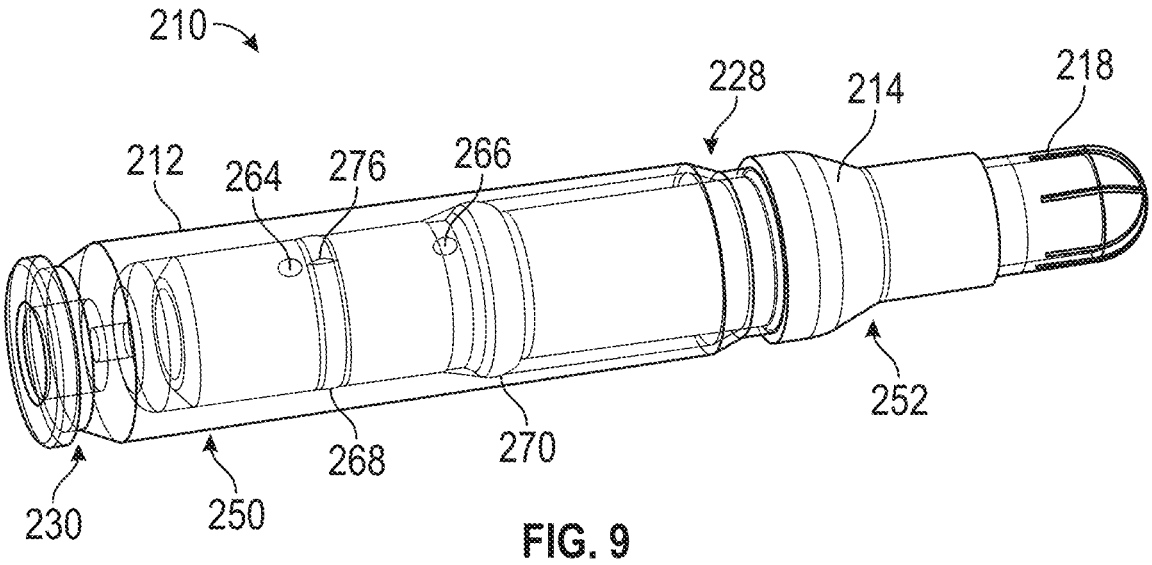
FIG. 9 shows a perspective view of an embodiment of the marking cartridge having a notched seal as described below.
Figure 10:
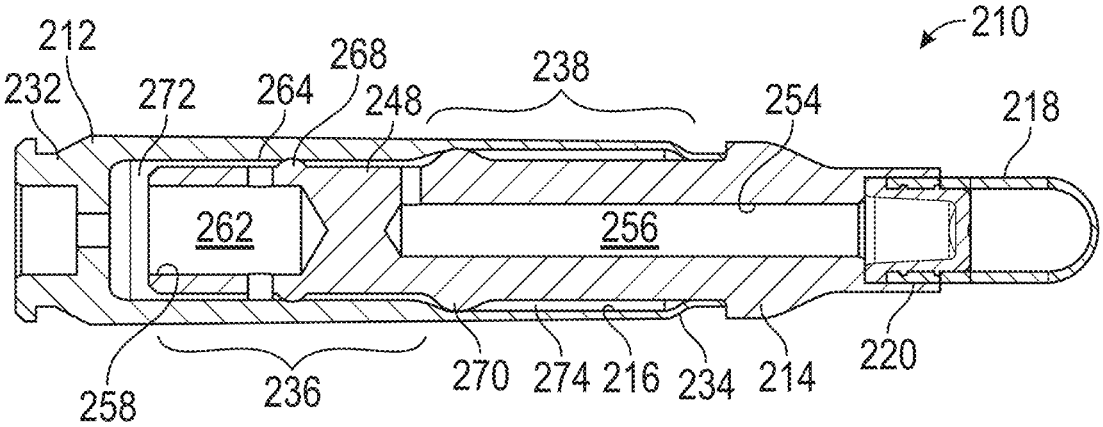
FIG. 10 is a cross-section of the marking cartridge shown in FIG. 9.

With particular reference to FIGS. 9-10, an embodiment of a reduced energy marking cartridge 210 similar to marking cartridge 10 is illustrated. Similar reference numbers will be used to identify similar components illustrated in these embodiments. The cartridge 210 has a casing 212 and a sabot 214 telescopically received and supported in an axial bore 216 of the casing 212 for relative axial movement from a retracted position to an extended position. The cartridge 210 also includes a projectile 218 releasably disposed in a mouth 220 of the sabot 214. The casing 212 is a thin walled cylindrical component having an axial bore 218 extending from a muzzle end 228 toward a breech end 230 and terminating at a base 232. The axial bore 218 is divided into an aft portion 236, and a fore portion 238 between the aft portion 236 and the tapered portion 234.

The sabot 214 includes a sabot body 248 having a breech end 250 and a muzzle end 252 forming the sabot mouth 220. A blind bore 254 extends axially from the sabot mouth 220 into the sabot body 248 to form an acceleration chamber 256. A blind bore 258 extends from the breech end 250 of the sabot body 248 to form a sabot chamber 262. A bleed port or first vent hole 264 extends radially through the sabot body 248 into the sabot chamber 262. A second vent hole 266 extends radially through the sabot body 248 into the acceleration chamber 256. A first seal 268 is formed on the sabot body 248 between the first vent hole 264 and the second vent hole 266. A second seal 270 is formed on the sabot body 248 forward (in the direction of the muzzle end 252) of the second vent hole 266. In this embodiment, the second seal 270 functions as a catch for engaging the tapered portion 234 to limit the travel of the sabot 214 at the extended position relative to the casing 212. The aft and fore portions 236, 238 of the casing 212 and the sabot body 248 including the seals 268, 270 support the sabot 214 for sliding movement relative to the casing 212 and resist relative rotational movement, namely pitch and yaw of the sabot 214 relative to the casing 212.

As best seen in FIG. 9, a notch 276 is formed at an interface between the casing 212 and the first seal 268 for facilitating assembly of the cartridge 210. In particular, the notch 276 is sized to permit air contained in the casing 212 to flow into the venting chamber 274, through the vent holes 264, 266 to the acceleration chamber 256 and out of the sabot mouth 220, since the projectile 218 is not inserted at this point in the assembly process. While the notch 276 is shown as being formed in the first seal 268, one skilled in the art should appreciate that the notch may, alternatively be formed in the aft portion 236 of the casing 212.

The above-described features of the casing 212 and the sabot 214 cooperate to provide sealing means for effecting the multi-phase firing cycle. As shown in FIGS. 9 and 10, the first seal 268 of the sabot 214 engages the aft portion 236 of the casing 12 to define the combustion chamber 272. The second seal 270 engages the fore portion 240 of the casing 212 to define the venting chamber 274 behind (in the direction of the breech end) the second seal 270.

During a firing cycle of the cartridge 210, the above-described features of the casing 212 and the sabot 214 cooperate to provide the multi-phase firing cycle. The multi-phase firing cycle is initiate with an ignition phase during which the primer ignites the propellant in the combustion chamber 272 to generate a combustion gas. Combustion gas pressurizes the combustion chamber 272 including the sabot chamber 262 for sliding the casing 212 relative to the sabot 214 during a combustion phase. The first vent hole 264, the notch 276 and the second vent hole 266 define a leakage path for initially pressurizing (i.e., priming) the venting chamber 274 during the combustion phase of the firing cycle. At the end of the combustion phase, relative movement of the casing 212 and the sabot 214 exposes the first vent hole 264 to the venting chamber 274 enabling fluid communication from the sabot chamber 262 through the first vent hole 264, the venting chamber 274 and the second vent hole 266 into the acceleration chamber 256 in the firing phase. At the end of the firing phase, sufficient pressure has accumulated in the acceleration chamber 256 to propel the projectile 218 from the sabot mouth 220 for discharging the projectile 218 from the cartridge 210. Residual combustion gas in the combustion chamber 272 and the venting chamber 274 slides the sabot 214 forward relative to the casing 212 during the venting phase. Combustion gas in the venting chamber 274 passes through the second vent hole 266 and into the acceleration chamber 256 to be expelled from the casing 212 during the venting phase of the firing cycle. At the end of the venting phase, the sabot 214 reaches the extracted position relative to the casing 212 when the second seal 270 engages the tapered portion 234.

Figure 11:
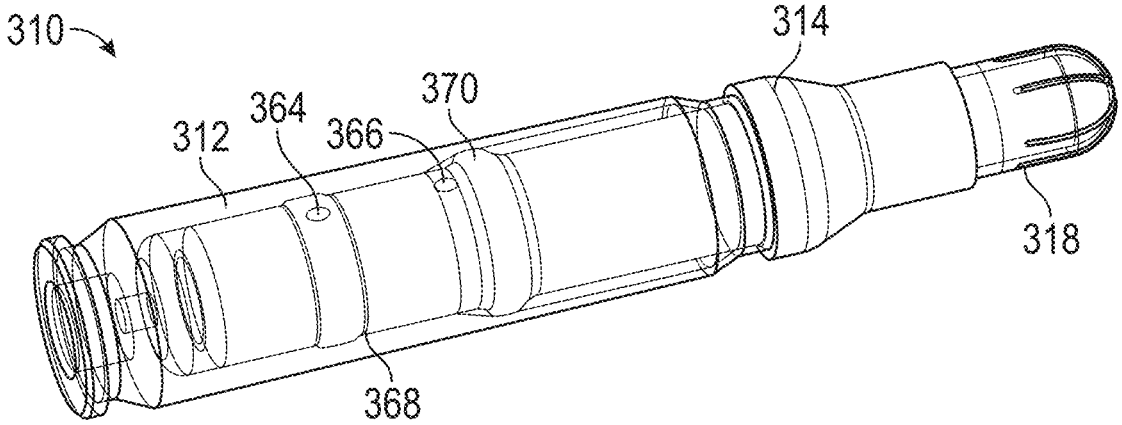
FIG. 11 shows a perspective view of an embodiment of the marking cartridge having a vent-through seal configuration as described below.
Figure 12:
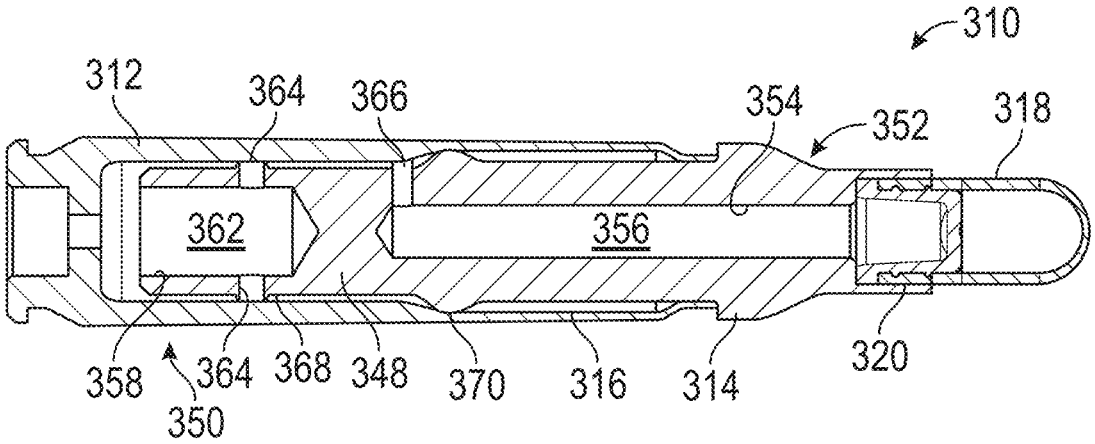
FIG. 12 is a cross-section of the marking cartridge shown in FIG. 11.

With reference to FIGS. 11-12, an embodiment of a reduced energy marking cartridge 310 similar to marking cartridge 10 is illustrated. Similar reference numbers will be used to identify similar components illustrated in these embodiments. The cartridge 310 has a casing 312 and a sabot 314 telescopically received and supported in an axial bore 316 of the casing 312 for relative axial movement from a retracted position to an extended position. The cartridge 310 also includes a projectile 318 releasably disposed in a mouth 320 of the sabot 314. The description of components for cartridge 310 that are identical to cartridge 10 are repeated only as needed for context.

The sabot 314 includes a sabot body 348 having a breech end 350 and a muzzle end 352. A blind bore 354 extends axially from the sabot mouth 320 into the sabot body 348 to form an acceleration chamber 356. A blind bore 358 extends from the breech end 350 of the sabot body 348 to form a sabot chamber 362. A bleed port or first vent hole 364 extends radially through the sabot body 348 into the sabot chamber 362. A second vent hole 366 extends radially through the sabot body 348 into the acceleration chamber 356. A first seal 368 is formed on the sabot body 348 around the first vent hole 364. A second seal 370 is formed on the sabot body 348 forward (towards the muzzle end 352) of the second vent hole 366. While not illustrated in FIGS. 11 and 12, the first seal 368 may include a notch, which is similar in structure and function to the notch shown and described in reference to cartridge 210.

Figure 13:
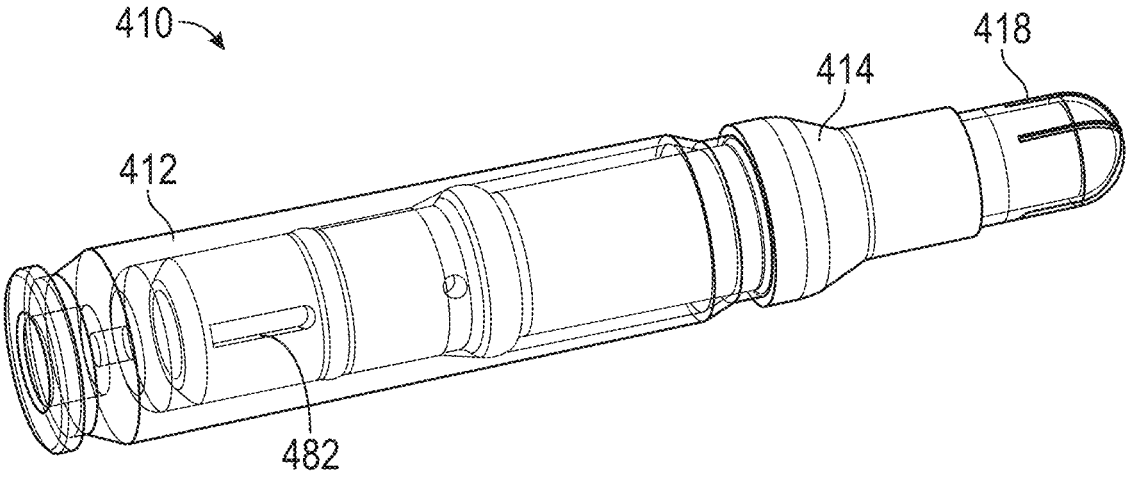
FIG. 13 shows a perspective view of an embodiment of the marking cartridge having a slotted combustion chamber vent as described below.
Figure 14:
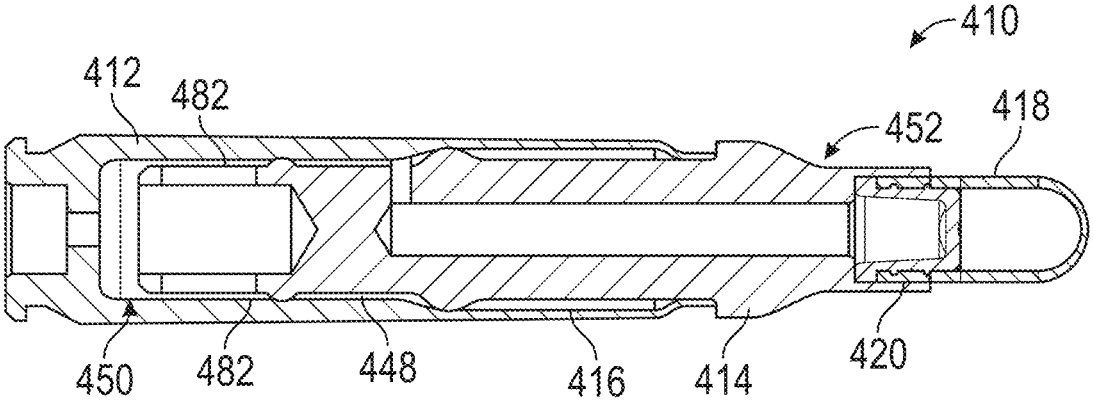
FIG. 14 is a cross-section of the marking cartridge shown in FIG. 13.

With reference to FIGS. 13-14, an embodiment of a reduced energy marking cartridge 410 similar to marking cartridge 10 is illustrated. Similar reference numbers will be used to similar components illustrated in these embodiments. The cartridge 410 has a casing 412 and a sabot 414 telescopically received and supported in an axial bore 416 of the casing 412 for relative axial movement from a retracted position to an extended position. The cartridge 410 also includes a projectile 418 releasably disposed in a mouth 420 of the sabot 414. The description of components for cartridge 410 that are identical to cartridge 10 are repeated only as needed for context.

The sabot 414 includes a sabot body 448 having a breech end 450 and a muzzle end 452. As best seen in FIG. 14, a pair of slots 482 are formed in a rear portion of the sabot body 448. The axial slots 482 function in a manner similar to the first vent hole 64 shown and described in reference to cartridge 10 for providing fluid communication between the combustion chamber 472 and the venting chamber 474. The use of a slot, instead of a hole, is easier to accurately form in the sabot body 448 and provides tighter control of the vent chocking parameters. In particular, the surface area of the axial slot 482 becomes more progressive (i.e., increase) as the sabot 414 slides forward relative to the casing 412. Axial slots 482 are illustrated as captive slots that do not extend to the breech end 450 of the sabot body 448. It should, however, be appreciated that a slot configuration that extends to the breech end 450 may be employed. Moreover, slot 482 is illustrated as a pair of relatively wide, oppositely-oriented through slots. However, it should be understood that the number, sizing, configuration and orientation of axial slots may be varied to provide desired vent chocking parameters and tuning the firing cycle of the cartridge 410.

Figure 15:
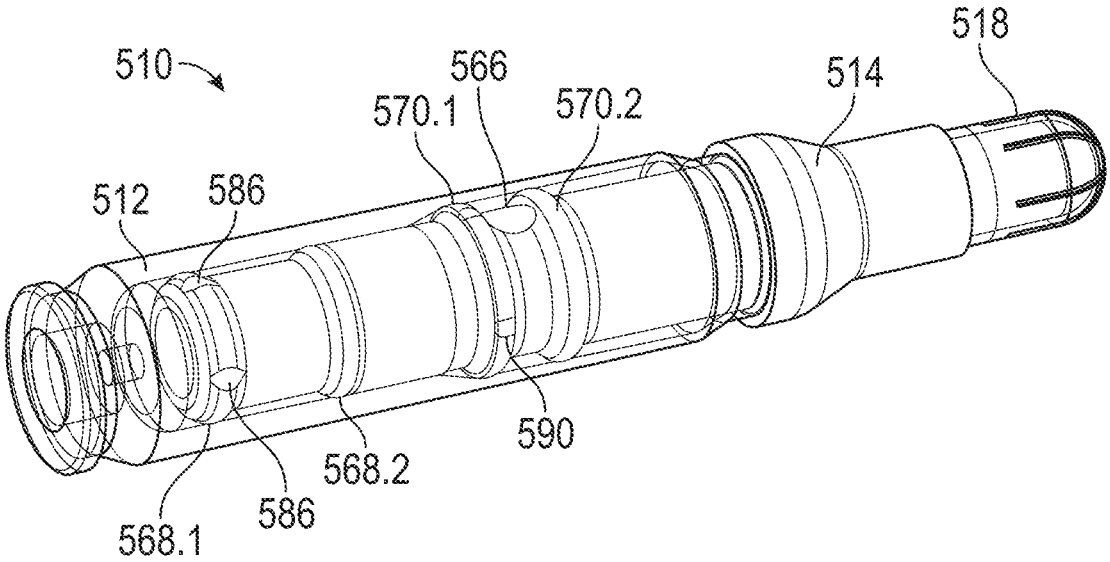
FIG. 15 shows a perspective view of an embodiment of the marking cartridge having a quad seal configuration as described below.
Figure 16:
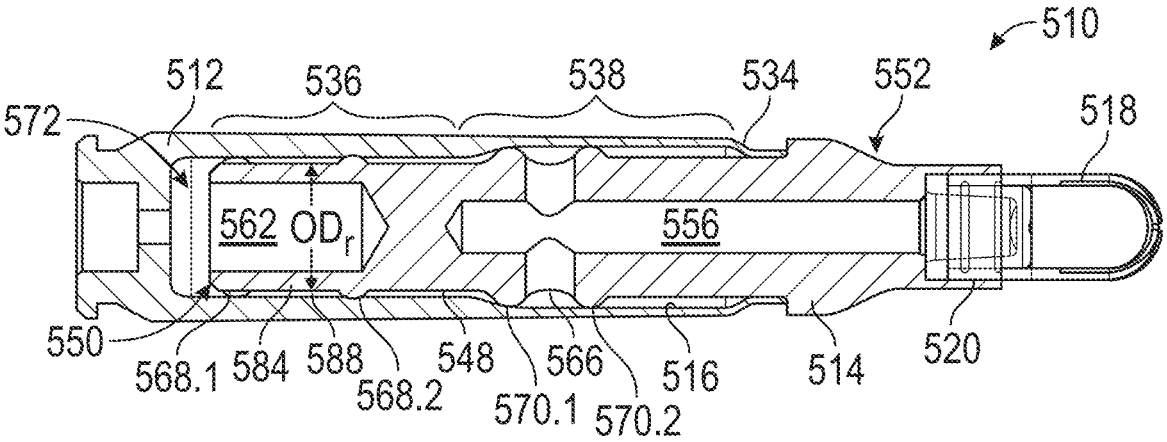
FIG. 16 is a cross-section of the marking cartridge shown in FIG. 15.

With reference to FIGS. 15-16, an embodiment of a reduced energy marking cartridge 510 similar to marking cartridge 10 is illustrated. Similar reference numbers will be used to similar components illustrated in these embodiments. The cartridge 510 has a casing 512 and a sabot 514 telescopically received and supported in an axial bore 516 of the casing 512 for relative axial movement from a retracted position to an extended position. The cartridge 510 also includes a projectile 518 releasably disposed in a mouth 520 of the sabot 514. The description of components for cartridge 510 that are identical to cartridge 10 are repeated only as needed for context.

The sabot 514 includes a sabot body 548 having a breech end 550 and a muzzle end 552. The rear portion of the sabot body 548 has a reduced outer diameter $OD_r$ defining an annular skirt 584 at the breech end 550 of the sabot 514. A first set of seals 568.1, 568.2 (collective referred to as seals 568) are formed on the annular skirt 584. Notches 586 extend axially across seal 568.1 to enable the flow of combustion gas from the combustion chamber 572 to pressurize the space 588 between the annular skirt 584 and the seals 568. A second set of seals 570.1, 570.2 (collectively referred to as seals 570) are formed on opposite sides of the second vent hole 566 extending though the sabot body 548. Notches 590 extend axially across seal 570.1 to enable the flow of combustion gas from venting chamber 574 through the second vent hole 566 and into the acceleration chamber 556.

The above-described features of the casing 512 and the sabot 514 cooperate to provide sealing means for effecting the multi-phase firing cycle. As shown in FIGS. 15 and 16, the seals 568 engage the aft portion 536 of the casing 512 to define the combustion chamber 572 and function as a choke for controlling the flow of combustion gas therefrom. The seals 570 engage the fore portion 538 of the casing 512 to define the venting chamber 574 and function as full seals for controlling the flow of combustion gas from the combustion chamber 572 into the acceleration chamber 556. Notches 586, 590 may be configured in various sizes, number, shapes and arrangement to adjust the desired flow choke parameters. While the embodiment illustrated in FIG. 16 includes a sabot chamber 562 in the sabot body 548, such feature may be eliminated. Moreover, the reduced diameter of the annular skirt 584 reduces shot to shot variations in the projectile velocity since the notches 586, 590 have meaningful effect on combustion gas flow, instead of the relative dimensions between the inner diameter of the casing 512 and the outer diameter of the sabot 514.

During a firing cycle of the cartridge 510, the above-described features of the casing 512 and the sabot 514 cooperate to provide the multi-phase firing cycle. The multi-phase firing cycle includes an ignition phase during which the primer (not shown) ignites the propellant (not shown) in the combustion chamber 572 to generate combustion gas which pressurizes the combustion chamber 572 including the space 588 between the annular skirt 584 and the seals 568 for sliding the casing 512 relative to the sabot 514 during an expansion phase. At the end of the expansion phase, relative movement of the casing 512 and the sabot 514 moves seal 568.2 into the venting chamber 574 allowing combustion gas to flow though the vent holes 566 into the acceleration chamber 556. At the end of the firing phase, sufficient pressure has accumulated in the acceleration chamber 556 to propel the projectile 518 from the sabot mouth 520. Residual combustion gas in the combustion chamber 572 slides the sabot 514 forward relative to the casing 512 during the venting phase. Combustion gas from the combustion chamber 572 also leaks past the seal 568.1 via notches 586 through the venting chamber 574 and the second vent hole 566 into the acceleration chamber 556 to be expelled from the casing 512 during a venting phase of the firing cycle. At the end of the venting phase, the sabot 514 reaches the extracted position relative to the casing 512 when the seal 570.2 engages the tapered portion 534.

Figure 17:
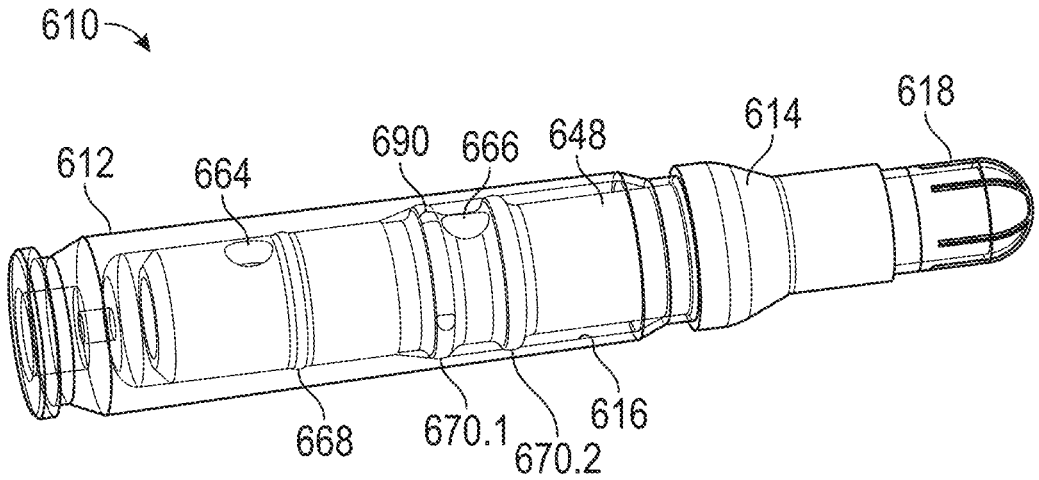
FIG. 17 shows a perspective view of an embodiment of the marking cartridge having a tri-seal configuration as described below.
Figure 18:
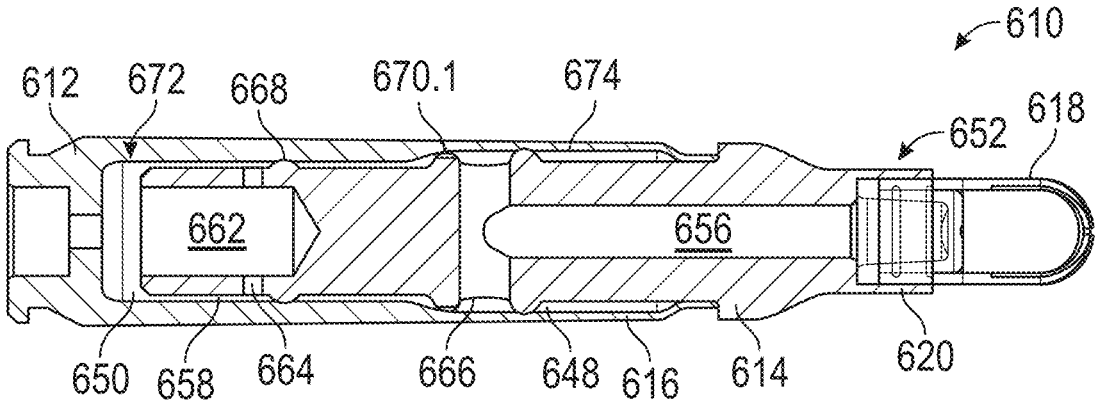
FIG. 18 is a cross-section of the marking cartridge shown in FIG. 17.

With reference to FIGS. 17-18, an embodiment of a reduced energy marking cartridge 610 similar to marking cartridge 10 is illustrated. Similar reference numbers will be used to similar components illustrated in these embodiments. The cartridge 610 has a casing 612 and a sabot 614 telescopically received and supported in an axial bore 616 of the casing 612 for relative axial movement from a retracted position to an extended position. The cartridge 610 also includes a projectile 618 releasably disposed in a mouth 620 of the sabot 614. The description of components for cartridge 610 that are identical to cartridge 10 are repeated only as needed for context.

The sabot 614 includes a sabot body 648 having a breech end 650 and a muzzle end 652. A blind bore 654 extends axially from the sabot mouth 620 into the sabot body 648 to form an acceleration chamber 656. A blind bore 658 extends from the breech end 652 of the sabot body 648 to form a sabot chamber 662. A first vent hole 664 extends radially through the sabot body 648 into the sabot chamber 662. A second vent hole 666 extends radially through the sabot body 648 into the acceleration chamber 656. A first seal 668 is formed on the sabot body 648 between the first vent hole 664 and the second vent hole 666. A second set of seals 670.1, 670.2 (collectively referred to as 670) are formed on the sabot body 648 on opposite sides of the vent hole 666 extending though the sabot body 648. Notches 690 extend axially across seal 670.1 to enable the flow of combustion gas from the venting chamber 674 through the vent hole 666 and into the acceleration chamber 656. In this configuration, the notched seal 670.1 functions as a support element for engaging the fore portion 638 of the casing 612 and maintaining a coaxial alignment of the sabot 614 relative to the casing 612 without significant effecting the choke characteristics of the valving mechanism.

The above-described features of the casing 612 and the sabot 614 cooperate to provide sealing means for effecting the multi-phase firing cycle and rely on similar principles to those employed in cartridge 510 by substituting a vent hole 664 for the rearmost first seal 568.1 to controlling the flow of combustion gas from the combustion chamber 672 into the venting chamber 674. Flow choke control is provided by the number, size, shape, configuration and orientation of the notches 690 form in seal 670.1 in combination with the size of the vent holes 664, 666.

Figure 19:
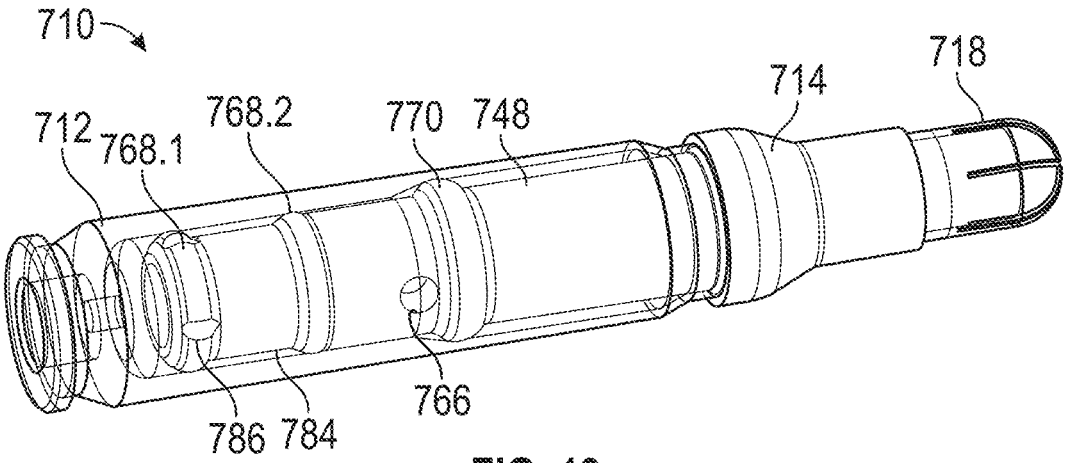
FIG. 19 shows a perspective view of another embodiment of the marking cartridge having a tri-seal configuration as described below.
Figure 20:
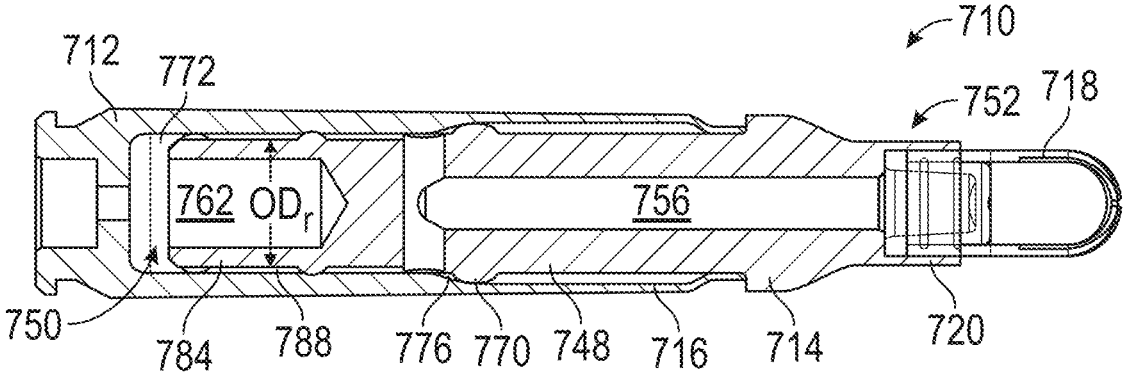
FIG. 20 is a cross-section of the marking cartridge shown in FIG. 19.
Figure 21:
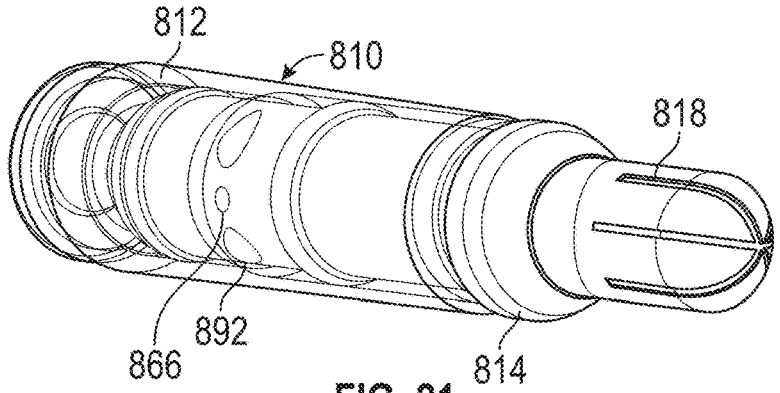
FIG. 21 shows a perspective view of an embodiment of the marking cartridge having a bi-seal configuration as described below.

With reference to FIGS. 19-20, an embodiment of a reduced energy marking cartridge 710 similar to marking cartridge 10 and cartridge 510 is illustrated. Similar reference numbers will be used to similar components illustrated in these embodiments. The cartridge 710 has a casing 712 and a sabot 714 telescopically received and supported in an axial bore 716 of the casing 712 for relative axial movement from a retracted position to an extended position. The cartridge 710 also includes a projectile 718 releasably disposed in a mouth 720 of the sabot 714. The description of components for cartridge 710 that are identical to cartridge 10 are repeated only as needed for context.

The sabot 714 includes a sabot body 748 having a breech end 750 and a muzzle end 752. The rear portion of the sabot body 748 has a reduced outer diameter $OD_r$ defining an annular skirt 784 at the breech end 750 of the sabot 714. A first set of seals 768.1, 768.2 (collective referred to as seals 768) are formed on the annular skirt 784. Notches 786 extend axially across seal 768.1 to enable the flow of combustion gas from the combustion chamber 772 to pressurize the space 788 between the annular skirt 784 and the first set of seals 768. A second seal 770 is formed on the sabot body 748 forward (in the direction of the muzzle end 752) of the vent hole 766 extending though the sabot body 748 into the acceleration chamber 756.

The number, size, shape, configuration and orientation of the notches 786 formed in seal 768.1 and the volume provided in the space 788 between the annular skirt 784 and the first set of seal 768.1 can be tuned to accumulate sufficient combustion gas at suitable pressure, to be released during the firing phase. This accumulation of combustion gas, which is severely choked, will occur relatively slowly over the expansion phase. Once the accumulated combustion gas is released during the firing phase, a small gas leak path remains contributing to the acceleration of the projectile. When properly tuned, the cartridge 710 will deliver consistent shot to shot projection velocities.

With reference to FIGS. 21-24, an embodiment of a reduced energy marking cartridge 710 similar to marking cartridge 10 and cartridge 710 is illustrated. Similar reference numbers will be used to similar components illustrated in these embodiments. The cartridge 810 has a casing 812 and a sabot 814 telescopically received and supported in an axial bore 816 of the casing 812 for relative axial movement from a retracted position to an extended position. The cartridge 810 also includes a projectile 818 releasably disposed in a mouth 820 of the sabot 814. The description of components for cartridge 710 that are identical to cartridge 10 are repeated only as needed for context.

Figure 23:
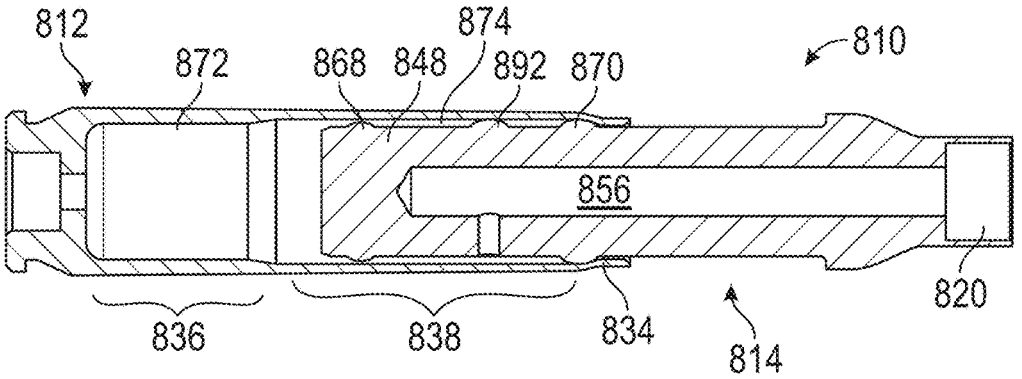
FIG. 23 is a cross-section of the embodiment similar to FIG. 22 with the sabot in the extended position.
Figure 24:
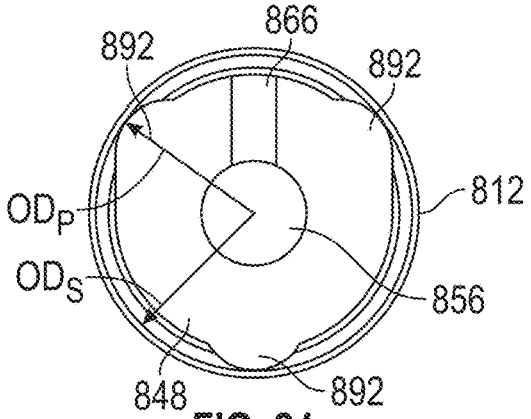
FIG. 24 is a radial cross-section of the marking cartridge take at line 24-24 shown in FIG. 22.

The sabot 814 includes a sabot body 848 having a breech end 850 and a muzzle end 852 forming the sabot mouth 820. It should be noted that the breech end 850 of the sabot body 848 does not include a sabot chamber or a vent hole extending into a sabot chamber as shown and described for cartridges 10 or 710. A vent hole 866 extends radially through the sabot body 848 into the acceleration chamber 856. A first seal 868 is formed on the sabot body 848 between the breech end 850 and the vent hole 866. A second seal 870 is formed on the sabot body 848 forward of the vent hole 866. As shown in FIG. 23, the second seal 870 functions as a catch for engaging the tapered portion 834 of the casing 812 to limit the travel of the sabot 814 at the extended position relative to the casing 812. Three protuberances or bumps 892 (two shown) are equally spaced around the sabot body 848 between the first and second seals 868, 870 at the axial location of the vent hole 866. The protuberances 892 define a support element for engaging the fore portion 838 of the casing 812 and maintaining a coaxial alignment of the sabot 814 relative to the casing 812. The additional support provided by the protuberances 892 in the fore portion 838 is particularly suitable for marking cartridge configurations having a relatively short sabot body. As best seen in FIG. 24, the outer diameter OD of the protuberances 892 corresponds with the outer diameter ODs of the second seal 870, and thus may be formed within a mold volume established for the sabot body 848. The axial bore 816 including the inner surfaces of the aft and fore portions 836, 838 cooperate with the sabot body 848 including the seals 868, 870 and the protuberances 892 to support the sabot 14 for sliding movement relative to the casing 812 and resist relative rotational movement, namely pitch and yaw of the sabot 814 relative to the casing 812. The number, sizing, configuration and orientation of protuberances may be varied to provide the desired support for the sabot body 848.

Figure 22:
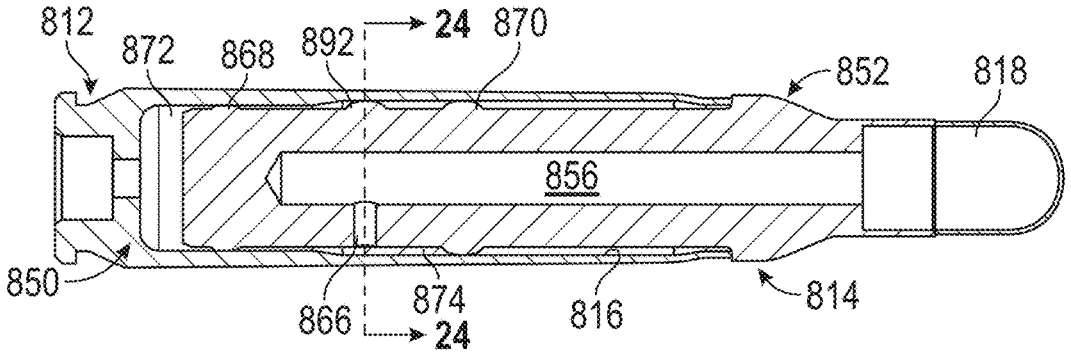
FIG. 22 is a cross-section of the marketing cartridge shown in FIG. 21.

The above-described features of the casing 812 and the sabot 814 cooperate to provide sealing means for effecting the multi-phase firing cycle. As best seen in FIG. 22, the first seal 868 engages the aft portion 836 of the casing 812 to define a sealed combustion chamber 872 between the base 832 and the breech end 850 of the sabot body 48. In this configuration, the aft portion 836 and the first seal 868 provide a first sealing means between the base 832 of the casing 812 and the sabot body 848.

As the sabot 814 slides forward (to the right) relative to the casing 812, the first seal 868 disengages from the aft portion 836 of the axial bore 816 and is positioned in the fore portion 838. The second seal 870 engages the walls of the fore portion 838 to form a venting chamber 874 behind (to the left) of the second seal 870. In this configuration, the aft portion 836, the fore portion 838 and the second seal 870 provide a second sealing means. Combustion gas continues to pressurize the combustion chamber 872, but also pressurizes the venting chamber 874 as it is able to flow past the first seal 868 and the protuberances 892. The number, sizing, configuration and orientation of protuberances may also be varied to minimize the choke effects to provide the desired choke characteristics for the flow of combustion gas from the combustion chamber 872 to the venting chamber 874. Fluid communication of combustion gas is also established from the venting chamber 874 into the acceleration chamber 856 via the second vent hole 866. Pressure in the acceleration chamber 856 increases to a level for dislodging the projectile 818 from the sabot mouth 820 and propelling it into a barrel bore (not shown).

As shown in FIG. 23, the sabot 814 has moved further forward and the second seal 870 of the sabot body 848 engages the tapered portion 834 formed on the casing 812. With the projectile (not shown) discharged from the cartridge 810, the vent holes 866 provides fluid communication from the combustion chamber 872 and the venting chamber 874 through the acceleration chamber 856 and the sabot mouth 820 to depressurize the cartridge 810.

Figure 25:
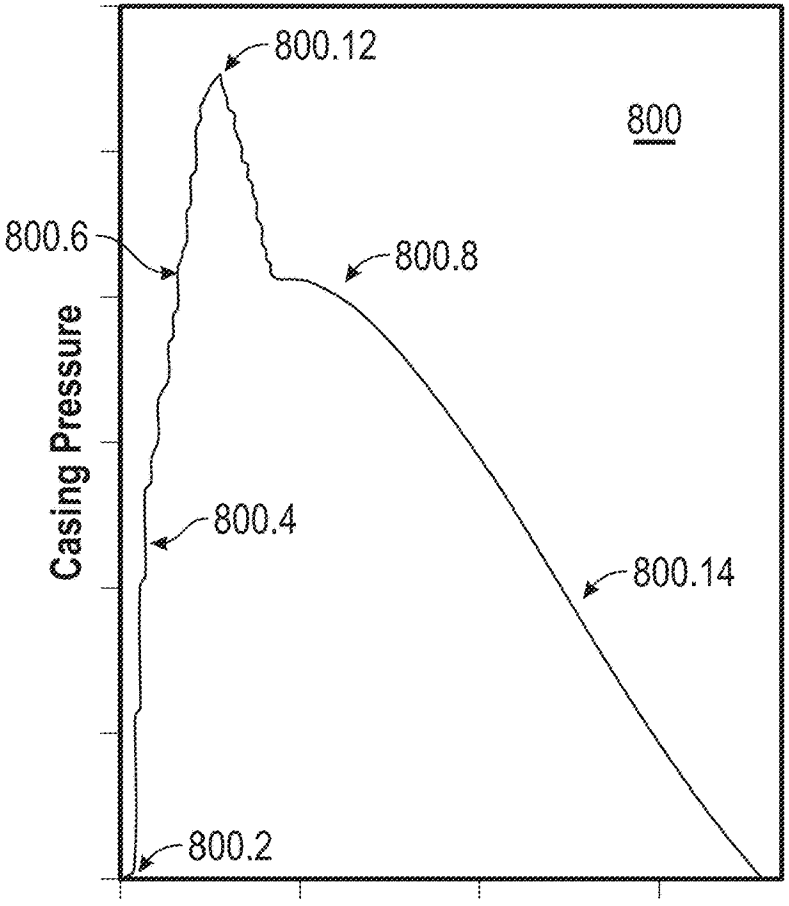
FIG. 25 is a plot of time vs. casing pressure graphically illustrating the schema of the multi-phase firing cycle of the marking cartridge shown in FIGS. 21-24.

During a firing cycle of the cartridge 810, the above-described features cooperate to provide a multi-phase firing cycle 800 as schematically represented in FIG. 25. The multi-phase firing cycle 800 includes an ignition phase 800.2 during which the propellant is ignited and starts to generate combustion gas in combustion chamber 872. At 800.4, an expansion phase is initiated with the first and second sealing means engaged such that the sabot 814 begins to slide relative to the casing 812. The burning propellant generates combustion gas which pressurizes the combustion chamber 872 during a combustion phase 800.6. The pressurized combustion gas continues to force casing 812 and sabot 814 in opposite directions until it reaches the extended position at 800.8. During the expansion phase, the first sealing means is disrupted allowing combustion gas to pass into the fore portion 838, through the vent hole 866 and into the acceleration chamber 856. Unlike the firing cycle 100 shown in FIG. 8, the firing phase 800.12 overlaps the combustion phase 800.6 such that the projectile is dislodged from the casing while the combustion phase continues. At the end 800.8 of the combustion phase 800.6, the projectile 18 has been dislodged from the sabot mouth 20 and a venting phase 800.14 is initiated.

Figure 26:
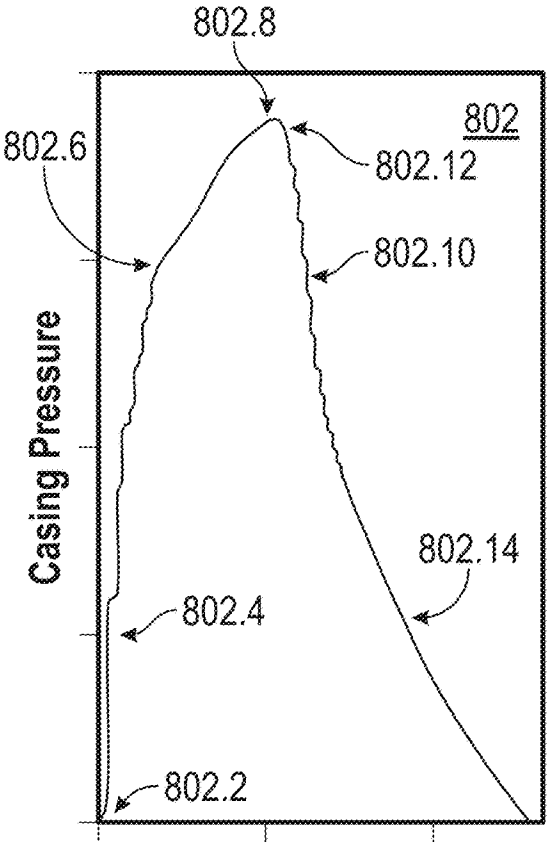
FIG. 26 is a plot of time vs. casing pressure similar to FIG. 25 for a first modified marking cartridge.
Figure 27:
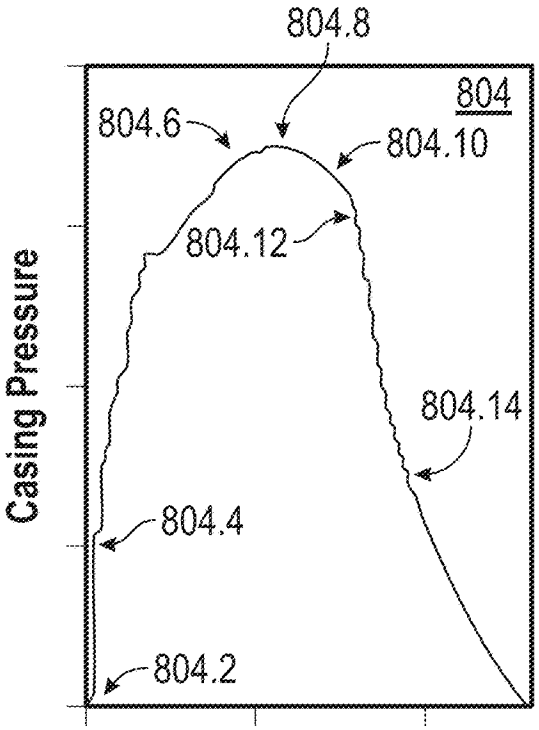
FIG. 27 is a plot of time vs. casing pressure similar to FIG. 25 for a second modified marking cartridge.
Figure 28:
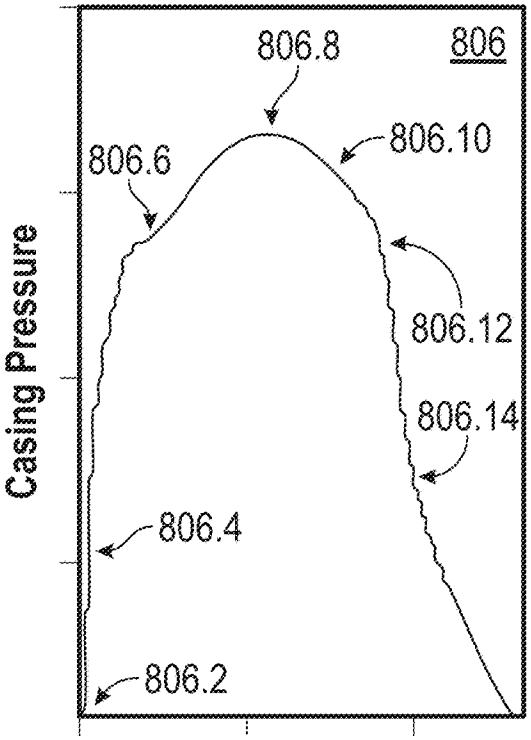
FIG. 28 is a plot of time vs. casing pressure similar to FIG. 25 for a third modified marking cartridge.
Figure 29:
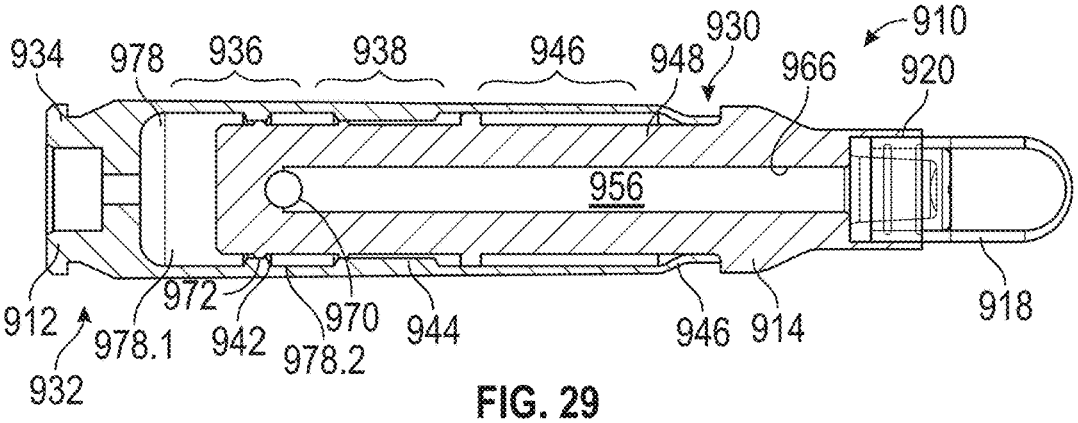
FIG. 29 is a cross-section of another embodiment of the marking cartridge in the combustion phase of the firing cycle.
Figure 30:
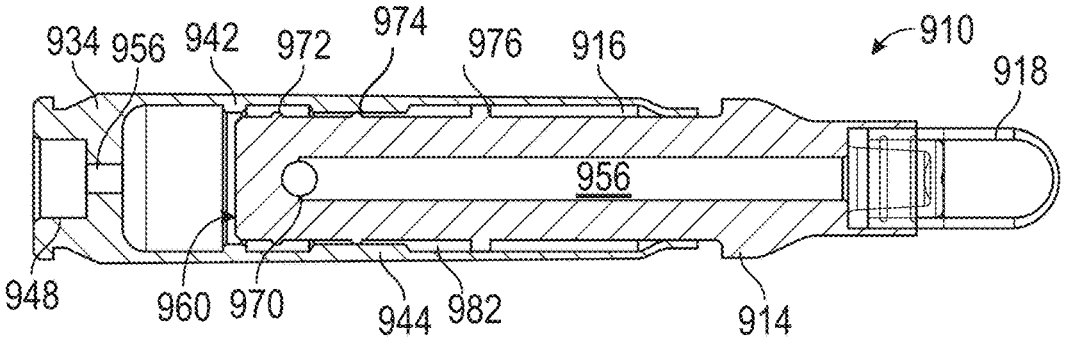
FIG. 30 shows a cross-section similar to FIG. 29 in the firing phase of the firing cycle.
Figure 31:
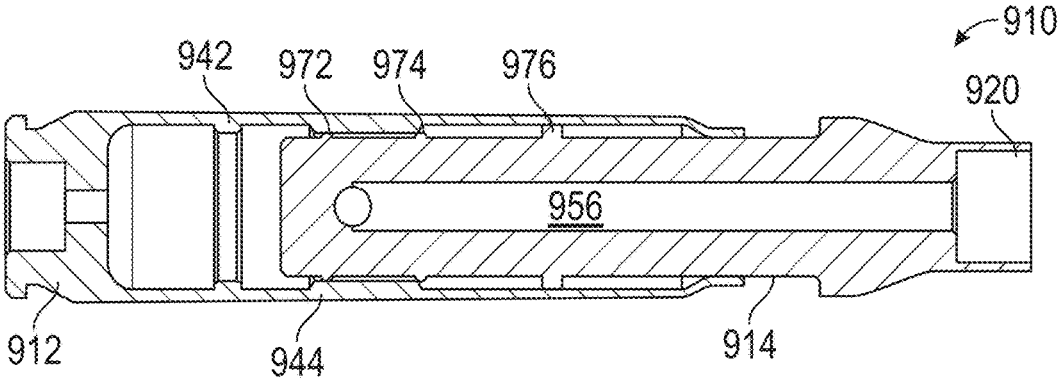
FIG. 31 shows a cross-section similar to FIG. 29 in the expansion phase of the firing cycle.
Figure 32:
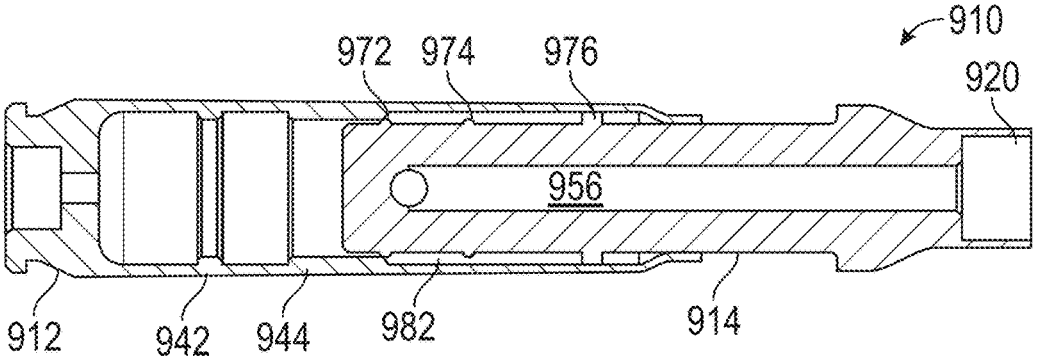
FIG. 32 shows a cross-section similar to FIG. 29 in the venting phase of the firing cycle.

One skilled in the art should understand that the timing (i.e., initiation and duration) of the various phases in the firing cycle may be adjusted by modifying the relative location of the components making up the first and second sealing means. FIGS. 26-28 illustrate the effects from modifying the axial location of the first seal 868 on the sabot 814. As explained above, the firing cycle 800 illustrated in FIG. 25 is for the seal location shown in FIG. 23. The firing cycles 802, 804, 806 illustrated in FIGS. 26-28 represent embodiments similar to that shown in FIG. 23 with the first seal 868 incrementally shifted (to the left) away from the vent hole 866. By moving the first seal 868 in either direction axially on the sabot 814, the timing of the firing phase 802.12, 804.12, 806.12 relative to the combustion phase 802.6/802.8, 804.6/804.8, 806.6/806.8 and the expansion phase 802.4/802.10, 804.4/804.10, 806.4/806.10 can be modified.

With reference now to FIGS. 25-28, the structure of the marking cartridge 910 and their spatial relationship for achieving a multi-phase firing cycle are further described. The casing 912 is a thin walled cylindrical component having an axial bore 916 extending from a muzzle end 930 toward a breech end 932 and terminating at a base 934. The axial bore 916 is divided into an aft portion 936, a middle portion 938 and a fore portion 940. The aft portion 936 extends between the base 934 and a first shoulder 942. The middle portion 938 extends between the first shoulder 942 and a second shoulder 944. The fore portion 940 extends from the second shoulder 944 to the muzzle end 930 of the casing 912. The muzzle end 930 of the casing 912 has a tapered portion 946 formed therein, which functions as a limit to the travel of the sabot 914 relative to the casing 912 during the firing cycle, and therefore is referred to herein as a stop. The configuration of the tapered portion 946 also serves to provide a seal to the sabot 914 at the muzzle end 930 of the casing 912. A primer pocket 948 is formed in the base 934 and has a flash port 950 extending from the primer pocket 948 to the axial bore 916.

The sabot 914 includes a sabot body 958 having a breech end 960 and a muzzle end 964 where the sabot mouth 920 is formed. A blind bore 966 extends axially from the sabot mouth 920 into the sabot body 948 to form an acceleration chamber 956. A vent hole 970 extends radially through the sabot body 958 into the acceleration chamber 956. A first seal 972 is formed on the sabot body 948 between the vent hole 970 and the breech end 960. A second seal 974 is formed on the sabot body 948 forward (in the direction of the muzzle end 964) of the vent hole 970. A catch 976 is formed forward of the second seal 974 at a travel limit of the sabot 914 in the extended position relative to the casing 912. The shoulders 942, 944 of the casing 912 and the sabot body 948 including the seals 972 and the catch 976 support the sabot 914 for sliding movement relative to the casing 912 and resist relative rotational movement, namely pitch and yaw of the sabot 914 relative to the casing 912 during the firing cycle.

The above-described features of the casing 912 and the sabot 914 cooperate to provide sealing means for effecting the multi-phase firing cycle. As shown in FIG. 25, the first seal 972 of the sabot 914 engages the first shoulder 942 of the casing 912 to define a sealed combustion chamber 978 of the casing 912 between the base 934 and a breech end 960 of the sabot body 958. In this configuration, the first shoulder 942 and the first seal 972 provide a first sealing means for forming a first portion 978.1 of the combustion chamber 978 between the base 934 of the casing 912 and the breech end 960 of the sabot body 958.

As shown in FIG. 26, the sabot 914 has moved forward such that the first seal 972 is disengaged from the first shoulder 942. In this position, the second seal 974 engages the second shoulder 944 to define a second portion 978.2 of the combustion chamber 978 in the casing 912. In this phase, the vent hole 970 provides fluid communication between the combustion chamber 978 and the acceleration chamber 968 in the sabot body 958 to propel the projectile 918. In this configuration, the second seal 974 and the second shoulder 944 provide a second sealing means for forming the combustion chamber 978 (collectively the first and second portions 978.1, 978.2).

As shown in FIG. 27, the sabot 914 has moved further forward such that the first and second seals 972, 974 engage the second shoulder 944 of the casing 912. In this position, the projectile 918 has been discharged from the sabot 914 and the vent hole 970 is sealed off from the combustion chamber 978 for cycling the cartridge 910.

As shown in FIG. 28, the sabot 914 has moved further forward such that the vent hole 970 is in fluid communication with a venting chamber 982 formed between the fore portion 940 of the casing 912 and the catch 976 of the sabot body 958. In this position, the first and second seals 972 are disposed in the vent chamber 982 which is, in turn, in fluid communication with the combustion chamber 978. The vent hole 970 provides fluid communication from the venting chamber 982 through the acceleration chamber 956 to the sabot mouth 920. In this configuration, the catch 976 engages the tapered portion 946 of casing 912 to provide a third sealing means for forming the venting chamber 982 between a fore portion 940 of the casing 912 and the sabot body 958.

The multi-phase firing cycle of cartridge 910 includes an ignition phase during which the primer (not shown) ignites the propellant (not shown) in the combustion chamber 978 to generate a combustion gas. Combustion gas pressurizes the combustion chamber 978 for sliding the casing 912 relative to the sabot 914 during a combustion phase. At the end of the combustion phase 100.6, relative movement of the casing 912 and the sabot 914 exposes the vent hole 970 to the combustion chamber 978. Continued relative movement of the casing 912 and the sabot 914 enables combustion gas to pressurize the combustion chamber 978, pass through the vent hole 970 and into the acceleration chamber 968 in a firing phase. At the end of the firing phase, sufficient pressure has accumulated in the acceleration chamber 968 to propel the projectile 918 from the sabot mouth 920 for discharging the projectile 918 from the cartridge 910. Further relative movement of the casing 912 and the sabot 914 seals the combustion chamber 978 from the vent hole 970 for continuing to pressurize the combustion chamber 978 during a cycling phase of the firing cycle. The cycling phase re-establishes a close volume in the casing 912 which is re-pressurized after firing the projectile 918 until the propellant is completely consumed to ensure that the sabot 914 extends to the limit of the travel and to facilitate cycling of the weapon system used to fire the cartridge 910. As the sabot 914 travels toward the extended position relative to the casing 912, the vent hole 970 establishes fluid communication with the venting chamber 982 and vents combustion gas from the combustion chamber 978, through the vent hole 970 and into the acceleration chamber 968 for expelling combustion gas from the casing 912 during a venting phase of the firing cycle. At the end of the venting phase, the sabot 914 reaches the extracted position relative to the casing 912 when the catch 976 on the sabot body 958 engages the tapered portion 946 formed in the casing 912. The catch 976, in combination with the size and configuration of the tapered portion 946 of the casing 12 may be sized and configured to minimize the radial stress imparted on the casing 912 by the sabot 914 sliding into the fully extending position for ensuring that the sabot 914 is retained the casing 912 and for allowing proper cycling of the cartridge 910.

The foregoing description of various embodiments has been provided for purposes of illustration and understanding of the marking cartridge described and claimed herein. It is not intended to be exhaustive or to limit the disclosure or claimed subject matter. For example, some embodiments illustrate the vent hole as a single bore, whereas other embodiments illustrate the vent hole as multiple bores. Likewise, some embodiments illustrate a chamber formed in the breech end of the sabot with or without a bleed hole, whereas other embodiments illustrate a sabot body without a sabot chamber or a bleed hole. Thus, individual elements or features of a particular embodiment are generally not limited to that particular embodiment, but, where applicable, are interchangeable and can be used in a selected embodiment, even if not specifically shown or described. The same may also be varied in many ways, some of which are explained here. Such variations are not to be regarded as a departure from the disclosure, and all such modifications are intended to be included within the scope of this disclosure.

What is claimed is:

1. A reduced-energy cartridge having a multi-phase firing cycle, the cartridge comprising:

a casing having an axial bore including an aft portion extending from a base at a breech end of the cartridge and a fore portion terminating at a muzzle end of the cartridge;

a sabot including a sabot body, a sabot mouth formed at the muzzle end, a blind bore extending axially from the sabot mouth into the sabot body to form an acceleration chamber, and a vent hole extending radially through the sabot body into the acceleration chamber, wherein the sabot is telescopically received in the axial bore and coupled to the casing for relative movement from a retracted position to an extended position;

a first seal disposed on the sabot body and engaging the aft portion of the casing to form a combustion chamber between the base and the sabot body;

a second seal disposed on the sabot body between the first seal and the sabot mouth and engaging the fore portion of the casing to form a venting chamber in the fore portion of the casing around the sabot body;

a propellant disposed in the aft portion of the casing and ignitable to produce a combustion gas; and a projectile releasably disposed in the sabot mouth and configured to be propelled from the sabot;

wherein the multi-phase firing cycle includes:

a combustion phase, wherein the first seal engages the aft portion to seal the combustion chamber such that combustion gas pressurizes the combustion chamber for sliding the casing relative to the sabot;

a firing phase, wherein the first seal disengages the aft portion and fluid communication is established from the combustion chamber for pressurizing the acceleration chamber to propel the projectile from the sabot mouth; and a venting phase, wherein the venting chamber is in fluid communication with the acceleration chamber for expelling combustion gas from the casing through the sabot mouth.

2. The reduced-energy cartridge of claim 1, further comprising a support element disposed on the sabot body between the first seal and the second seal engaging the fore portion of the casing to support relative movement of the sabot therein.

3. The reduced-energy cartridge of claim 2, wherein the support element comprises at least one protuberance formed on the sabot body.

4. The reduced-energy cartridge of claim 1, further comprising an axially-extending notch at an interface between the first seal and the casing for controlling fluid communication across the first seal.

5. The reduced-energy cartridge of claim 1, wherein the sabot further comprises a blind bore extending into the sabot body from the breech end to form a sabot chamber and a bleed port extending radially through the sabot body into the sabot chamber;

the multi-phase firing cycle further comprising an expansion phase after the combustion phase, wherein the bleed port is sealed in the aft portion and the acceleration chamber is in fluid communication with the venting chamber via the vent hole; and wherein fluid communication is established from the combustion chamber through the bleed port, into the venting chamber, and through the vent hole during the firing phase for pressurizing the acceleration chamber to propel the projectile from the sabot mouth.

6. The reduced-energy cartridge of claim 5, wherein the bleed port is formed through the first seal disposed on the sabot body.

7. The reduced-energy cartridge of claim 5, wherein at least one of the first seal and the second seal comprises an annular band forming an interference fit with the casing when the sabot is located in the axial bore.

8. The reduced-energy cartridge of claim 1, wherein the sabot further comprises an axial slot formed in the sabot body and extending from the first seal towards the breech end of the sabot body;

wherein fluid communication is established from the combustion chamber through the slot, into the venting chamber, and through the vent hole during the firing phase for pressurizing the acceleration chamber to propel the projectile from the sabot mouth.

9. The reduced-energy cartridge of claim 1, wherein the sabot further comprises an annular skirt formed on the breech end of the sabot body, wherein the annular skirt has a reduced outer diameter relative to an outer dimeter of the sabot body.

10. The reduced-energy cartridge of claim 9, wherein the first seal comprises a pair of seals including an aft seal and a fore seal formed on the annular skirt, wherein the aft seal has at least one axially-extending notch formed therein for controlling fluid communication across the aft seal.

11. The reduced energy cartridge of claim 1, wherein the second seal comprises a pair of seals including an aft seal and a fore seal formed on opposite sides of the vent hole, wherein the aft seal has at least one axially-extending notch formed therein for controlling fluid communication across the aft seal.

12. The reduced-energy cartridge of claim 1, wherein a catch portion of the sabot body is configured to engage the muzzle end of the casing for limiting the sliding of the sabot relative to the casing during the venting phase of the firing cycle.

13. The cartridge case of claim 12, wherein the casing comprises a tapered end portion extending from the fore portion to the muzzle end of the casing, wherein the catch portion is configured to engage the casing at an interface between the fore portion and the tapered end portion sabot for limiting the sliding of the sabot relative to the casing during the venting phase of the firing cycle.

14. The reduced-energy cartridge of claim 1, wherein the casing further comprises a primer pocket formed in the base, a flash hole extending through the base from the primer pocket to the combustion chamber, and a primer disposed in the primer pocket for completing the firing sequence.

15. The reduced-energy cartridge of claim 1, wherein the projectile comprises a frangible shell, a marking compound disposed in the frangible shell and a base coupled to the frangible shell for sealing the marking compound therein.

16. The reduced-energy cartridge of claim 1, wherein the sabot further comprises a third seal disposed on the sabot between the first and second seals such that the vent hole is located between the first and third seal;

the multi-phase firing cycle further comprising an expansion phase after the firing phase, wherein the vent hole is sealed in the fore portion of the casing to prevent fluid communication from the combustion chamber into the acceleration chamber.

17. A reduced-energy cartridge having a multi-phase firing cycle, the cartridge comprising:

a casing having an axial bore including an aft portion extending from a base at a breech end of the cartridge and a fore portion terminating at a muzzle end of the cartridge, wherein an inner diameter of the aft portion is smaller than the inner diameter of the fore portion;

a sabot including a sabot body, a sabot mouth formed at the muzzle end, a blind bore extending axially from the sabot mouth into the sabot body to form an acceleration chamber, and a vent hole extending radially through the sabot body into the acceleration chamber, wherein the sabot is telescopically received in the axial bore for relative movement from a retracted position to an extended position within the casing;

a first seal disposed on the sabot body, wherein the first seal engages the aft portion of the casing to form a combustion chamber between the base and the sabot body;

a second seal disposed on the sabot body between the vent hole and the sabot mouth, wherein the second seal engages the fore portion of the casing to form a venting chamber around the sabot body;

a support element disposed on the sabot body between the first seal and the second seal to engage the fore portion of the casing for supporting relative movement of the sabot therein;

a propellant disposed in the aft portion of the casing and ignitable to produce a combustion gas; and a projectile releasably disposed in the sabot mouth and configured to be propelled from the sabot;

wherein the multi-phase firing cycle includes:

a combustion phase, wherein the first seal engages the aft portion to seal the combustion chamber such that combustion gas pressurizes the combustion chamber for sliding the casing relative to the sabot;

a firing phase, wherein the first seal disengages the aft portion and fluid communication is established from the combustion chamber for pressurizing the acceleration chamber to propel the projectile from the sabot mouth; and a venting phase, wherein the venting chamber is in fluid communication with the acceleration chamber for expelling combustion gas from the casing through the sabot mouth.

18. The reduced-energy cartridge of claim 17, wherein the support element comprises at least one protuberance formed on the sabot body.

19. The reduced-energy cartridge of claim 18, wherein the support element comprises a plurality of protuberances equally spaced around on a circumference of the sabot body and axially aligned with the vent hole.

20. The reduced-energy cartridge of claim 17, wherein the support element comprises a notched seal disposed on the sabot body between the first seal and the vent hole.

* * * * *